US008031153B2

(12) United States Patent
Kang et al.

(10) Patent No.: US 8,031,153 B2
(45) Date of Patent: Oct. 4, 2011

(54) LIQUID CRYSTAL DISPLAY AND DRIVING METHOD THEREOF

(75) Inventors: Sin Ho Kang, Gyeonggi-do (KR); Jin Cheol Hong, Gyeongsangbuk-do (KR); Tae Hun Kim, Gyeongsangbuk-do (KR); Man Gyu Park, Seoul (KR); Seung Cheol O, Seoul (KR); Su Hyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1072 days.

(21) Appl. No.: 11/895,744

(22) Filed: Aug. 27, 2007

(65) Prior Publication Data

US 2008/0129904 A1 Jun. 5, 2008

(30) Foreign Application Priority Data

Nov. 30, 2006 (KR) ..... 10-2006-0119763
Nov. 30, 2006 (KR) ..... 10-2006-0119778
Jun. 29, 2007 (KR) ..... 10-2007-0064906

(51) Int. Cl.
*G09G 3/36* (2006.01)

(52) U.S. Cl. ..... 345/96; 345/94; 345/89; 345/98; 345/209

(58) Field of Classification Search ..... 345/94, 345/96, 87, 89, 98, 208–210
See application file for complete search history.

(56) References Cited

U.S. PATENT DOCUMENTS

2004/0104880 A1* 6/2004 Kang et al. ..... 345/94
2004/0135757 A1* 7/2004 Park et al. ..... 345/98
2004/0263447 A1* 12/2004 Hong et al. ..... 345/87

* cited by examiner

*Primary Examiner* — Lun-Yi Lao
*Assistant Examiner* — Shaheda Abdin
(74) *Attorney, Agent, or Firm* — Brinks Hofer Gilson & Lione

(57) ABSTRACT

A liquid crystal display for changing a supply sequence of a scanning pulse with which a plurality of gate lines are supplied to realize a one dot inversion, and a driving method thereof are disclosed.

In the liquid crystal display, a liquid crystal display panel has a plurality of data lines and a plurality of gate lines, which are crossed each other, and pixels, which are defined by the lines. A gate driver supplies scanning pulses to the gate lines, and changes a supply sequence of the scanning pulses for each frame. A data driver converts digital video data into data voltages and periodically inverts a polarity of the data voltages to supply the data voltages in accordance with a supply sequence of the scanning pulses. And a timing controller supplies the digital video data to the data driver, and controls the data driver and the gate driver, and wherein a polarity of data voltages, which are supplied to the liquid crystal display panel, is inverted for each liquid crystal cell and a polarity of a data voltage which is outputted from the data driver, is inverted for every two to four horizontal periods.

16 Claims, 27 Drawing Sheets

FIG. 3
RELATED ART

| | | | |
|---|---|---|---|
| + | − | + | − |
| − | + | − | + |
| + | − | + | − |
| − | + | − | + |
| + | − | + | − |
| − | + | − | + |
| + | − | + | − |

LIQUID CRYSTAL DISPLAY AND DRIVING METHOD THEREOF

This application claims the benefit of Korean Patent Application No. P2006-119763 and No. P2006-119778 filed in Korea on Nov. 30, 2006, and Korean Patent Application No. P2007-064906 filed in Korea on Jun. 29, 2007 which are hereby incorporated by reference.

BACKGROUND OF THE INVENTION

1. Field of the Invention

The present invention relates to a liquid crystal display, and more particularly to a liquid crystal display that is adaptive for changing a supply sequence of a scanning pulse with which a plurality of gate lines are supplied to realize a one dot inversion, and a driving method thereof.

2. Description of the Related Art

Generally, a liquid crystal display controls light transmittance of liquid crystal cells in accordance with video signals to display a picture. An active matrix type of liquid crystal display having a switching device provided for each liquid crystal cell is advantageous for an implementation of moving picture because it permits an active control of the switching device. The switching device used for the active matrix liquid crystal display mainly employs a thin film transistor (hereinafter, referred to as "TFT") as shown in FIG. 1.

Referring to FIG. 1, the liquid crystal display of the active matrix type converts digital input data into an analog data voltage on the basis of a gamma reference voltage to supply it to a data line DL and, at the same time supply a scanning pulse to a gate line GL, thereby charging a liquid crystal cell Clc.

A gate electrode of the TFT is connected to the gate line GL, a source electrode thereof is connected to the data line DL, and a drain electrode of the TFT is connected to a pixel electrode of the liquid crystal cell Clc and one end electrode of a storage capacitor Cst.

A common electrode of the liquid crystal cell Clc is supplied with a common voltage Vcom.

When the TFT is turned-on, the storage capacitor Cst charges a data voltage applied from the data line DL to constantly maintain a voltage of the liquid crystal cell Clc.

If a scanning pulse is applied to the gate line GL, the TFT is turned-on to define a channel between the source electrode and the drain electrode, thereby supplying a voltage on the data line DL to the pixel electrode of the liquid crystal cell Clc. In this case, liquid crystal molecules of the liquid crystal cell Clc are arranged by an electric field between the pixel electrode and the common electrode to modulate an incident light.

A configuration of the related art liquid crystal display including pixels which have such a structure is the same as shown in FIG. 2.

FIG. 2 is a diagram showing a configuration of a liquid crystal display of the related art.

Referring to FIG. 2, a liquid crystal display 100 of the related art includes a liquid crystal display panel 110 provided with a thin film transistor TFT that drives the liquid crystal cell Clc at an intersection where a plurality of data lines DL1 to DLm and a plurality of gate lines GL1 to GLn are crossed each other, a data driver 120 that supplies data to the data lines DL1 to DLm of the liquid crystal display panel 110, a gamma reference voltage generator 130 that generates a gamma reference voltage to supply it to the data driver 120, a backlight assembly 140 that irradiates a light onto the liquid crystal display panel 110, an inverter 150 that applies an AC voltage and a current to the backlight assembly 140, a common voltage generator 160 that generates a common voltage Vcom to supply it to the common electrode of the liquid crystal cell Clc of the liquid crystal display panel 110, a gate driving voltage generator 170 that generates a gate high voltage VGH and a gate low voltage VGL to supply them to the gate driver 130, a timing controller 180 that controls the data driver 120 and the gate driver 130, and a gate driver 190 that supplies a scanning pulse to the gate lines GL1 to GLn of the liquid crystal display panel 110.

The liquid crystal display panel 110 has a liquid crystal injected between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT The TFT supplies data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse applied, via the gate line which is connected to a gate terminal of the TFT among the gate lines GL1 to GLn, to the gate terminal thereof. Upon turning-on of the TFT, video data on a data line which is connected to a drain terminal of the TFT among the data lines DL1 to DLm are supplied to the pixel electrode of the liquid crystal cell Clc.

The data driver 120 supplies data to the data lines DL1 to DLm in response to a data driving control signal DDC supplied from the timing controller 180. Further, the data driver 120 samples and latches digital video data RGB fed from the timing controller 180, and then converts them into an analog data voltage capable of expressing a gray scale level at the liquid crystal cell Clc of the liquid crystal display panel 110 on the basis of a gamma reference voltage supplied from the gamma reference voltage generator 130, thereby supplying it the data lines DL1 to DLm.

The gamma reference voltage generator 130 receives a high-level power voltage VDD to generate a positive gamma reference voltage and a negative gamma reference voltage and output them to the data driver 120.

The backlight assembly 140 is provided at the rear side of the liquid crystal display panel 110, and is radiated by an alternating current voltage and a current supplied from the inverter 150 to irradiate a light onto the liquid crystal display panel 110.

The inverter 150 converts a square wave signal generated at the interior thereof into a triangular wave signal, and then compares the triangular wave signal with a direct current power voltage VCC supplied from the system to generate a burst dimming signal proportional to the result. If the burst dimming signal determined in accordance with the rectangular wave signal of the interior of the inverter 150 is generated, then a driving integrated circuit IC (not shown) controlling a generation of the AC voltage and a current within the inverter 150 controls a generation of AC voltage and current supplied to the backlight assembly 140 in accordance with the burst dimming signal.

The common voltage generator 160 receives a high-level power voltage VDD to generate a common voltage Vcom, and supplies it to the common electrode of the liquid crystal cells Clc of the liquid crystal display panel 110.

The gate driving voltage generator 170 is supplied with a high-level power voltage VDD to generate the gate high voltage VGH and the gate low voltage VGL, and supplies them to the gate driver 190. Herein, the gate driving voltage generator 170 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 190, respectively.

The timing controller 180 supplies digital video data RGB which are supplied from a scaler (not shown) for processing an image to the data driver 120. Herein, the scaler (not shown) for processing an image is included in a system such as a TV set or a computer monitor, etc. Furthermore, the timing controller 190 generates a data driving control signal DCC and a gate driving control signal GDC using horizontal/vertical synchronizing signals H and V in response to a clock signal CLK to supply them to the data driver 120 and the gate driver 190, respectively. Herein, the data driving control signal DDC includes a source shift clock SSC, a source start pulse SSP, a polarity control signal POL, and a source output enable signal SOE, etc. The gate driving control signal GDC includes a gate shift clock GSC, a gate start pulse GSP, and a gate output enable signal GOE, etc.

The gate driver 190 sequentially generates a scanning pulse, that is, a gate pulse in response to the gate driving control signal GDC which is supplied from the timing controller 180 to supply it to the gate lines GL1 to GLn. In this case, the gate driver 190 determines a high level voltage and a low level voltage of the scanning pulse in accordance with the gate high voltage VGH and the gate low voltage VGL, respectively. Herein, the gate high voltage VGH and the gate low voltage VGL are supplied from the gate driving voltage generator 170.

When the related art liquid crystal display having such configurations is driven by a one dot inversion method as shown in FIG. 3, if the gate driver 190 sequentially supplies the scanning pulse to the plurality of gate lines GL1 to GLn as shown in FIG. 4, a polarity of an analog data voltage, which is supplied from the data driver, is alternately converted on the basis of the common voltage Vcom. Herein, the analog data voltage is supplied with the data driver 120. If a polarity of the data voltage is converted whenever the data line is supplied with a data voltage, a temperature within the data driver 120 is risen. As a result, the related art liquid crystal display has a disadvantage in that an internal circuit of the data driver 120 is degraded.

SUMMARY OF THE INVENTION

The present invention is to solve the above-mentioned problem. Accordingly, it is an object of the present invention to provide a liquid crystal display that is adaptive for changing a supply sequence of a scanning pulse with which a plurality of gate lines is supplied to realize a one dot inversion, and a driving method thereof.

It is another object of the present invention to provide a liquid crystal display that is adaptive for changing a supply sequence of a scanning pulse with which a plurality of gate lines is supplied to realize a one dot inversion, thereby preventing a temperature rise of a circuit which supplies an analog data voltage, and a driving method thereof.

It is still another object of the present invention, in the case where a liquid crystal display changes a supply sequence of a scanning pulse with which a plurality of gate lines is supplied to realize a one dot inversion, to provide a liquid crystal display that is adaptive for changing a supply sequence of a scanning pulse at odd-numbered frames and a supply sequence of a scanning pulse at even-numbered frames to be symmetrical with each other to offset a picture quality deterioration which is caused by a non-uniform of a charge amount, and a driving method thereof.

It is still another object of the present invention to provide a liquid crystal display that is adaptive for changing supply sequences of an analog data voltage and a scanning pulse with which a plurality of horizontal lines are supplied to be corresponded to each other to reduce a polarity inversion period of a data voltage by half, and a driving method thereof.

It is still another object of the present invention to provide a liquid crystal display that is adaptive for reducing a polarity inversion period of a data voltage by half to reduce a temperature of a circuit which supplies an analog data voltage, and a driving method thereof.

It is still another object of the present invention to provide a liquid crystal display that is adaptive for reducing a temperature of a circuit which supplies an analog data voltage to prevent a degradation of the circuit.

In order to achieve these and other objects of the invention, a liquid crystal display according to the present invention comprises a liquid crystal display panel that has a plurality of data lines and a plurality of gate lines, which are crossed each other, and pixels, which are defined by the lines; a gate driver that supplies scanning pulses to the gate lines, and changes a supply sequence of the scanning pulses for each frame; a data driver that converts digital video data into data voltages and periodically inverts a polarity of the data voltages to supply the data voltages in accordance with a supply sequence of the scanning pulses; and a timing controller that supplies the digital video data to the data driver, and controls the data driver and the gate driver, and wherein a polarity of data voltages, which are supplied to the liquid crystal display panel, is inverted for each liquid crystal cell and a polarity of a data voltage which is outputted from the data driver, is inverted for every two to four horizontal periods.

The liquid crystal display panel is divided into k line blocks (k is a positive integer less than n/2) having n gate lines (n is an even number), and each of the line block is divided into a first and second sub-blocks having i gate lines (i is an even number less than n).

The gate driver shifts the scanning pulse toward an up-scanning direction and a down-scanning direction within the line block, and supplies the scanning pulse to the gate lines under the control of the timing controller.

A polarity pattern of the data voltage, which is supplied to pixel rows of the first sub-block, is different from a polarity pattern of the data voltage which is supplied to pixel rows of the second sub-block.

The gate driver sequentially supplies the scanning pulse to gate lines, which are included in the first sub-block, and then sequentially supplies the scanning pulse to gate lines which are included in the second sub-block.

The gate driver changes a supply sequence of the scanning pulse within the sub-block for the each frame.

The first sub-block includes odd-numbered gate lines, and the second sub-block includes even-numbered gate lines.

The liquid crystal display further includes a data re-aligner that re-aligns the digital video data in accordance with a supply sequence of the scanning pulses, and wherein the timing controller supplies the digital video data from the data re-aligner to the data driver.

The data driver includes a primary latch that samples and latches digital video data from the timing controller; a plurality of secondary latches that latch the digital video data in accordance with a supply sequence of the scanning pulses;

and a demultiplexer that distributes the digital video data to secondary latches in accordance with a supply sequence of the scanning pulses.

A method of driving a liquid crystal display according to an embodiment of the present invention, including a liquid crystal display panel that has a plurality of data lines and a plurality of gate lines which are crossed each other and pixels which are defined by the lines, a gate driver that supplies scanning pulses to the gate lines and changes a supply sequence of the scanning pulses for each frame, and a data driver that converts digital video data into data voltages and periodically inverts a polarity of the data voltages to supply the data voltages in accordance with a supply sequence of the scanning pulses, comprises diversely controlling a supply sequence of the scanning pulses for each frame; and supplying the data voltages to the data lines in accordance with a supply sequence of the scanning pulses, and wherein a polarity of data voltages, which are supplied to the liquid crystal display panel, is inverted for each liquid crystal cell and a polarity of a data voltage which is outputted from the data driver, is inverted for every two to four horizontal periods.

BRIEF DESCRIPTION OF THE DRAWINGS

These and other objects of the invention will be apparent from the following detailed description of the embodiments of the present invention with reference to the accompanying drawings, in which:

FIG. 3 is a diagram showing a polarity of a data voltage which is supplied to each of the pixels in a one dot inversion method;

DETAILED DESCRIPTION OF THE PREFERRED EMBODIMENT

Hereinafter, the preferred embodiments of the present invention will be described in detail with reference to the accompanying drawings.

Figure 5:
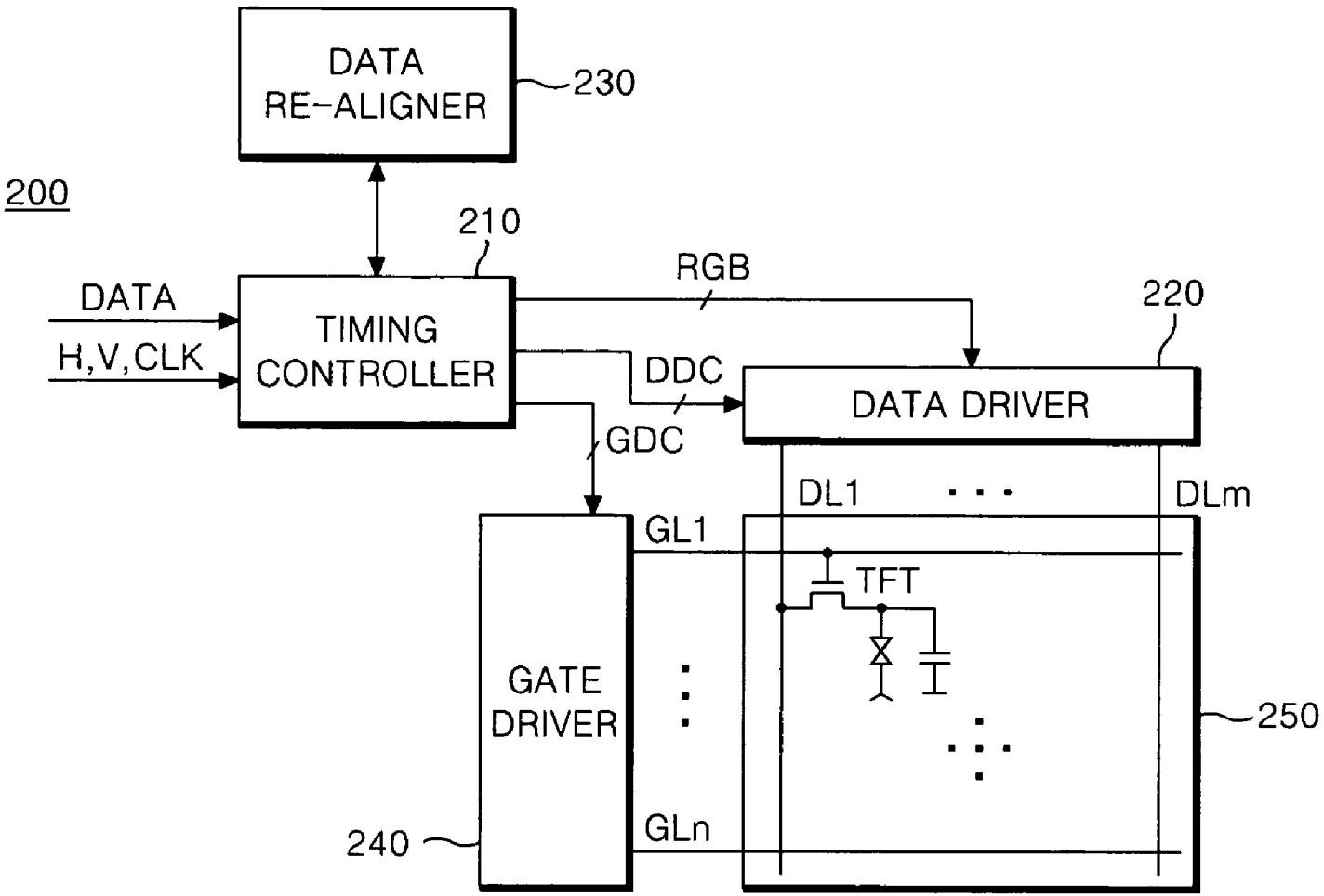
FIG. 5 is a block diagram showing a liquid crystal display according to an embodiment of the present invention.

Referring to FIG. 5, a liquid crystal display 200 according to the first embodiment of the present invention includes a data re-aligner 230, a timing controller 210, and a gate driver 240. Herein, the data re-aligner 230 is connected to the timing controller 210. The timing controller 210 controls a driving of an odd-numbered frame and an even-numbered frame, which are driven at a liquid crystal display panel 250 by a data driver 220, and a supply sequence of a scanning pulse. The gate driver 240 supplies a scanning pulse to the gate lines GL1 to GLn of the liquid crystal display panel 250 in accordance with a control of the timing controller 210.

Further, the liquid crystal display 200 of the present invention includes the liquid crystal display panel 250 and the data driver 220. Herein, the liquid crystal display panel 250 has a thin film transistor TFT which is formed at an intersection of the plurality of data lines DL1 to DLm and drives the liquid crystal cell Clc. The data driver 220 supplies data to the data lines DL1 to DLm of the liquid crystal display panel 250.

The data driver 220 converts digital video data from the timing controller 210 into an analog gamma compensation voltage to output positive data voltages and negative data voltages. Also, the data driver 220 outputs the same common voltage Vcom as a voltage of a common electrode, which is opposed to a pixel electrode, for a non-scan period (a high logic period of a SOE) between the positive data voltage and the negative data voltage, or outputs an average voltage of the positive data voltage and the negative data voltage, that is, a charge share voltage by shorting adjacent data lines for the non-scan period. The data driver 220 supplies analog data voltages to the data lines D1 to Dm using a two dots inversion method. In other words, the data driver 220 supplies the analog data voltages to the data lines D1 to Dm in a sequence of the positive data voltage, the positive data voltage, the common voltage (or charge share voltage), the negative data voltage, and the negative data voltage.

Digital video data is inputted to the data re-aligner 230 in a sequence of digital video data of the first pixel row, which are selected by a scanning pulse of the first gate line GL1, digital video data of the second pixel row, which are selected by a scanning pulse of the second gate line GL2, digital video data of the third pixel row, which are selected by a scanning pulse of the third gate line GL3, digital video data of the fourth pixel row, which are selected by a scanning pulse of the fourth gate line GL4, and . . . digital video data of the (n) th pixel row, which are selected by a scanning pulse of the (n) th gate line GLn, irrespective of a scanning sequence. The data re-aligner 230 re-aligns the digital video data to supply them to the timing controller 210 in accordance with a change of the following scanning sequence. To this end, the data re-aligner 230 includes a memory where the digital video data are stored, and a memory controller that generates read/write addresses of the memory.

The data re-aligner 230 may be mounted within the timing controller 210.

The timing controller 210 supplies digital video data RGB supplied from a system to the data driver 220, and generates a data driving control signal DDC and a gate driving control signal GDC using horizontal/vertical synchronizing signals H and V in accordance with a clock signal CLK inputted from a system to supply them to the data driver 220 and the gate driver 240, respectively. Herein, the data driving control signal DDC includes a source shift clock SSC, a source start pulse SSP, a polarity control signal POL, and a source output enable signal SOE, etc., and the gate driving control signal GDC includes a gate shift clock GSC, a gate start pulse GSP, a gate output enable signal GOE, and a scanning direction signal DIR, etc. The scanning direction signal DIR controls the gate driver 240 to allow the scanning pulses to be outputted in a sequence from the upper gate line toward the lower gate line (down-scanning direction), or to allow the scanning pulses to be outputted in a sequence from the lower gate line toward the upper gate line (up-scanning direction).

The gate driver 240 supplies the scanning pulse to the gate lines GL1 to GLn in response to the gate driving control signal, which is supplied from the timing controller 210, as follows. Such a gate driver 240 includes gate ICs that is capable of outputting the scanning pulses along the up-scanning direction or the down-scanning direction in accordance with the scanning direction signal DIR from the timing controller 210. For example, the gate ICs are a T6LE4 manufactured by a Toshiba Co., and a HM105066 manufactured by a Magnachip Co., Ltd.

A spatial polarity inversion period of a data voltage, which is supplied to the liquid crystal display panel 250 according to the embodiment of the present invention, is shorter than a polarity inversion period of a data voltage which is outputted from the data driver 220.

To this end, the liquid crystal display panel 250 is divided into k line blocks (k is a positive integer less than n/2) having n gate lines (n is an even number), and the line block is divided into a first and second sub-blocks having i gate lines (i is an even number less than n).

The first sub-block includes pixel rows that are charged with data voltages of a first polarity pattern, and the second sub-block includes pixel rows that are charged with data voltages of a second polarity pattern having a reverse polarity in comparison with the first polarity pattern.

Figure 6:
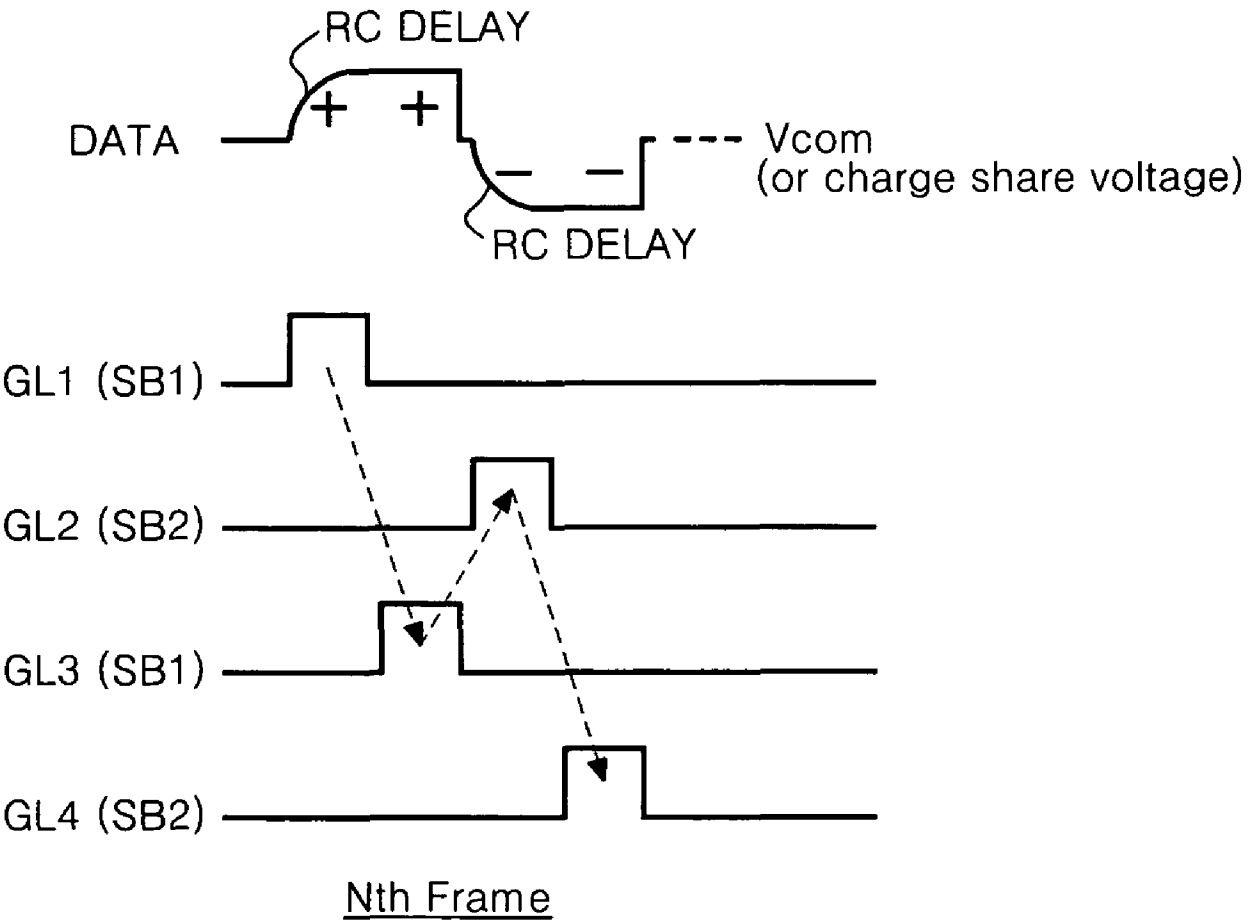
FIG. 6 is a waveform diagram showing a data and scanning pulses, which are generated for the (N)th frame period in the case where one line block includes four pixel rows in the liquid crystal display as shown in FIG. 5.

FIG. 6 shows scanning pulses and a data voltage which are supplied to the first and fourth gate lines GL1 to GL4 included in the first line block for the (N)th frame period (N is a positive integer). The gate driver 240 supplies the scanning pulses in a sequence from the first line block toward the (k)th line block. Herein, the gate driver 240 supplies all scanning pulses to four gate lines, which are arranged at the upper line block among k line blocks, and then supplies the scanning pulse to four gate lines which are arranged at the lower adjacent line block.

Referring to FIG. 6, the gate driver 240 supplies the scanning pulses in a sequence of the first gate line GL1, the third gate line GL3, the second gate line GL2, and the fourth gate line G4 at the first line block for the (N)th frame period. For the (N)th frame period, The data driver 220 is synchronized with the scanning pulses, which are supplied to the first and third gate lines GL1 and GL3, to output the data voltages of the first polarity pattern (+−−+ . . . +−−+) to be displayed to the first and third pixel rows, and then is synchronized with the scanning pulses, which are supplied to the second and fourth gate lines GL2 and GL4, to output the data voltage of the second polarity pattern (−++− . . . −++−) to be displayed to the second and fourth pixel rows. The data driver 220 inverts a polarity of a data voltage for each liquid crystal cell (one dot) in the pixel column in response to a polarity control signal POL which is inverted for each horizontal period for the (N)th frame period. The timing controller 210 supplies data, which are re-aligned by the data re-aligner 230, to the data driver 220 in a sequence of data of the first pixel row, data of the third pixel row, data of the second pixel row, and data of the fourth pixel row for the (N)th frame period.

Figure 7:
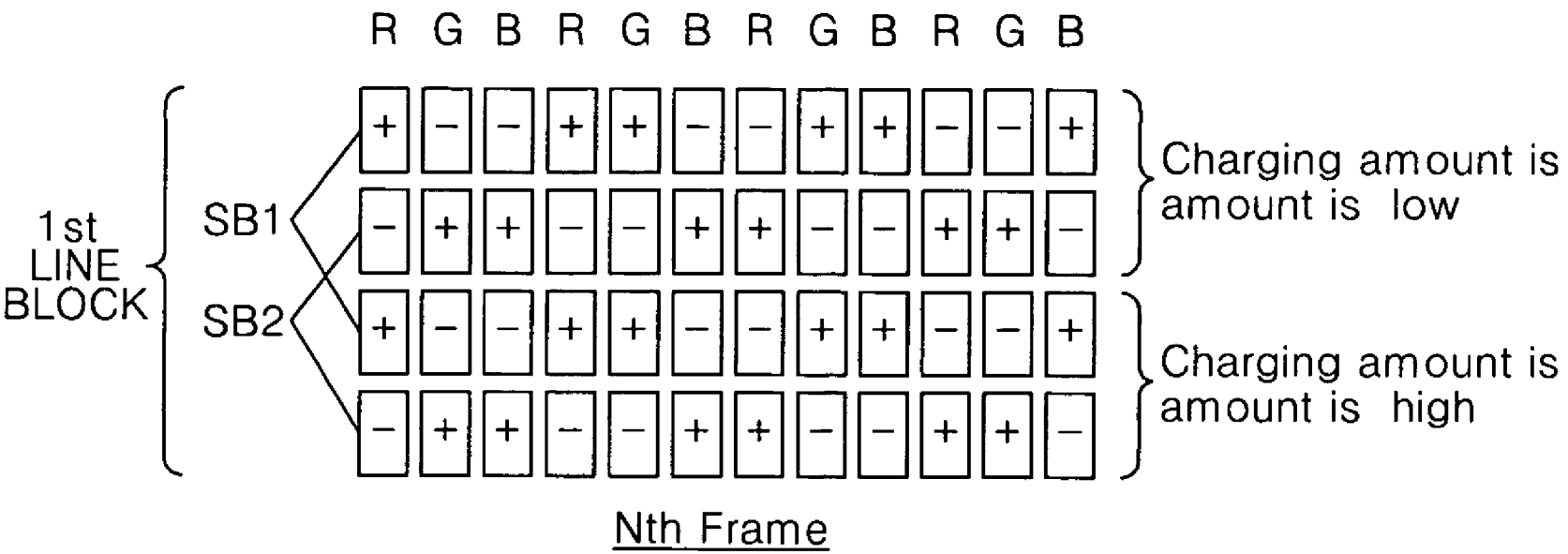
FIG. 7 is a diagram showing polarities and a charge amount of a data voltage which is charged in liquid crystal cells by the driving waveform of FIG. 6.

As shown in FIG. 6 and FIG. 7, the first line block is divided into the first and second sub-blocks SB1 and SB2. The first sub-block SB1 includes the first and third pixel rows, which are charged with a data voltage having the first polarity pattern (+−−+ . . . +−−+) for the (N)th frame period, and is selected by scanning pulses which are supplied to the first and third gate lines GL1 and GL3. The second sub-block SB2 includes the second and fourth pixel rows, which are charged with a data voltage having the second polarity pattern (−++− . . . −++−) for the (N)th frame period, and is selected by scanning pulses which are supplied to the second and fourth gate lines GL2 and GL4.

If the liquid crystal cells of the first line block is charged with the data voltages in the scanning sequence as shown in FIG. 6 for the (N)th frame period, the liquid crystal display panel is driven by a horizontal two dots inversion method and a vertical one dot inversion method as shown in FIG. 7. In other words, a polarity of the data voltage is inverted for each two dots (or adjacent two liquid crystal cells) in the pixel row, and a polarity of the data voltage is inverted for each dot (or one liquid crystal cell) in the pixel column. However, if the data voltage is scanned in the scanning sequence as shown in FIG. 6, the charge amounts of the first and second pixel rows become less than the charge amounts of the third and fourth pixel rows as shown in FIG. 7. This is caused by a fact that a data voltage of the first pixel row that is firstly charged in comparison with the third pixel row of two positive data voltages, which are continuously outputted to the data lines DL1 to DLm to be charged in the first and third pixel rows, is lowered by a RC delay for two horizontal periods as shown in FIG. 6. In the same manner, this is caused by a fact that a data voltage of the second pixel row that is firstly charged in comparison with the fourth pixel row of two positive data voltages, which are continuously outputted to the data lines DL1 to DLm to be charged in the second and fourth pixel rows, is lowered by a RC delay for the two horizontal periods. In other words, the charge amounts of the pixel rows, which are charged with the positive data voltage supplied following the negative data voltage, and the negative data voltage supplied following the positive data voltage, becomes less than that of the pixel rows which are charged with the positive data voltage supplied following the positive data voltage, and the negative data voltage supplied following the negative data voltage.

If a pixel row having a low charge amount is equal to a pixel row having a high charge amount, a flicker phenomenon caused by a brightness difference between lines can be generated on a display screen. Accordingly, the liquid crystal display according to the embodiment of the present invention inversely controls each scanning sequence of the first and second sub-blocks SB1 and SB2 in comparison with the (N+1)th frame period to change a location of the pixel row having a low charge amount and a location of the pixel row having a high charge amount with each other in the (N)th frame period and the (N+1)th frame period, thereby becoming uniform the charge amounts of all liquid crystal cells for two frame periods.

Figure 8:
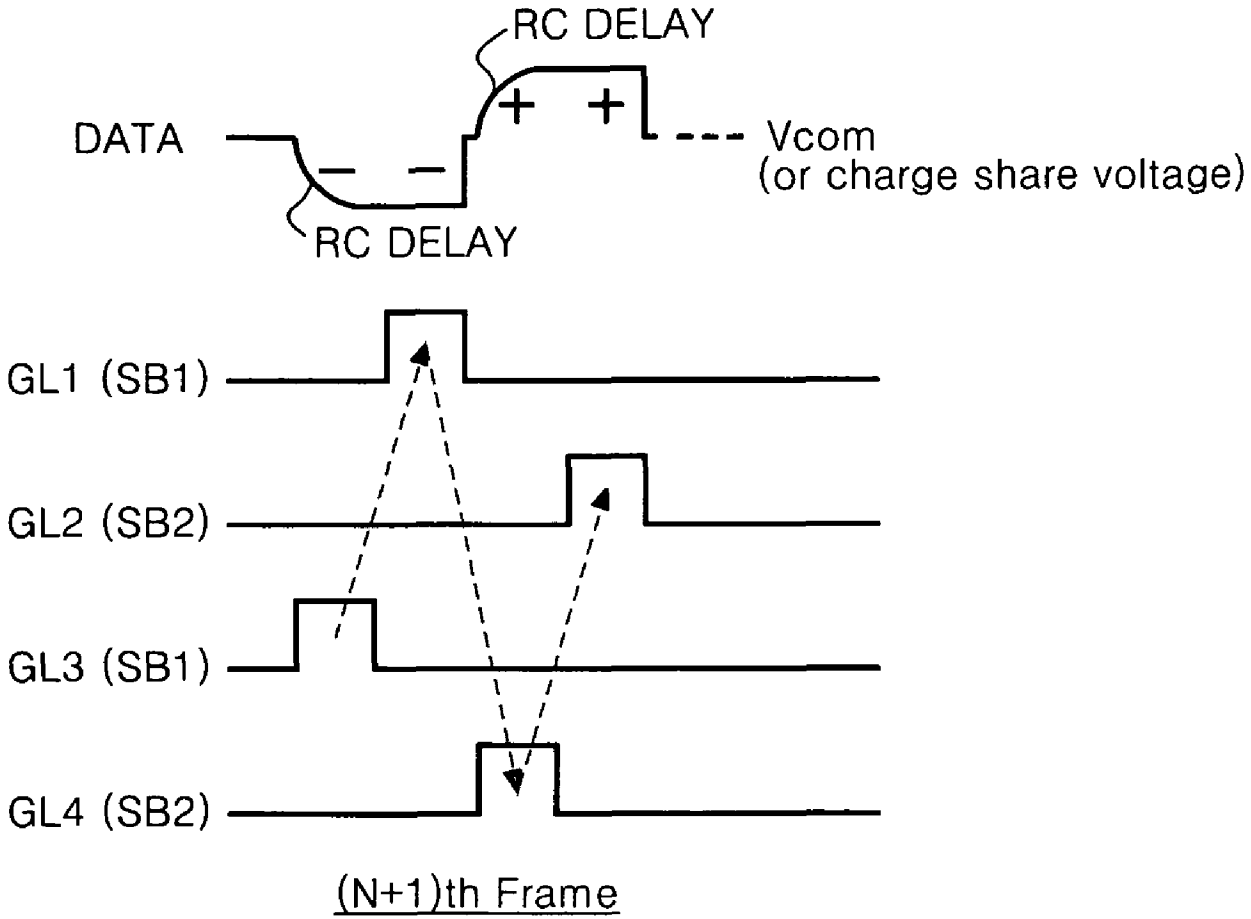
FIG. 8 is a waveform diagram showing a data and scanning pulses, which are generated for the (N+1)th frame period in the case where one line block includes four pixel rows in the liquid crystal display as shown in FIG. 5.

FIG. 8 shows scanning pulses and a data voltage which are supplied to the first and fourth gate lines GL1 to GL4 included in the first line block for the (N+1)th frame period. The gate driver 240 supplies the scanning pulses in a sequence from the first line block toward the (k)th line block. Herein, the gate driver 240 supplies all scanning pulses to four gate lines, which are arranged at the upper line block among k line blocks, and then supplies the scanning pulse to four gate lines which are arranged at the lower adjacent line block.

Referring to FIG. 8, the gate driver 240 supplies the scanning pulses in a sequence of the third gate line GL3, the first gate line GL1, the fourth gate line GL4, and the second gate line G2 at the first line block for the (N+1)th frame period.

For the (N+1)th frame period, the data driver 220 is synchronized with the scanning pulses, which are supplied to the first and third gate lines GL1 and GL3, to output the data voltages of the second polarity pattern (−++− . . . −++−) to be displayed to the first and third pixel rows, and then is synchronized with the scanning pulses, which are supplied to the second and fourth gate lines GL2 and GL4, to output the data voltages of the first polarity pattern (+−−+ . . . +−−+) to be displayed to the second and fourth pixel rows. The data driver 220 inverts a polarity of a data voltage for each liquid crystal cell (one dot) in the pixel column in response to a polarity control signal POL which is inverted for each horizontal period for the (N+1)th frame period. The timing controller 210 supplies data, which are re-aligned by the data re-aligner 230, to the data driver 220 in a sequence of the data of the third pixel row, the data of the first pixel row, the data of the fourth pixel row, and the data of the second pixel row for the (N+1)th frame period.

For the (N+1)th frame period, the first sub-block SB1 includes the first and third pixel rows that charge the data voltage having the second polarity pattern (−++− . . . −++−), and is selected by the scanning pulses which are supplied to the first and third gate lines GL1 and GL3. For the (N+1)th frame period, the second sub-block SB2 includes the second and fourth pixel rows that charge the data voltage having the first polarity pattern (+−−+ . . . +−−+), and is selected by the scanning pulses which are supplied to the second and fourth gate lines GL2 and GL4.

Figure 9:
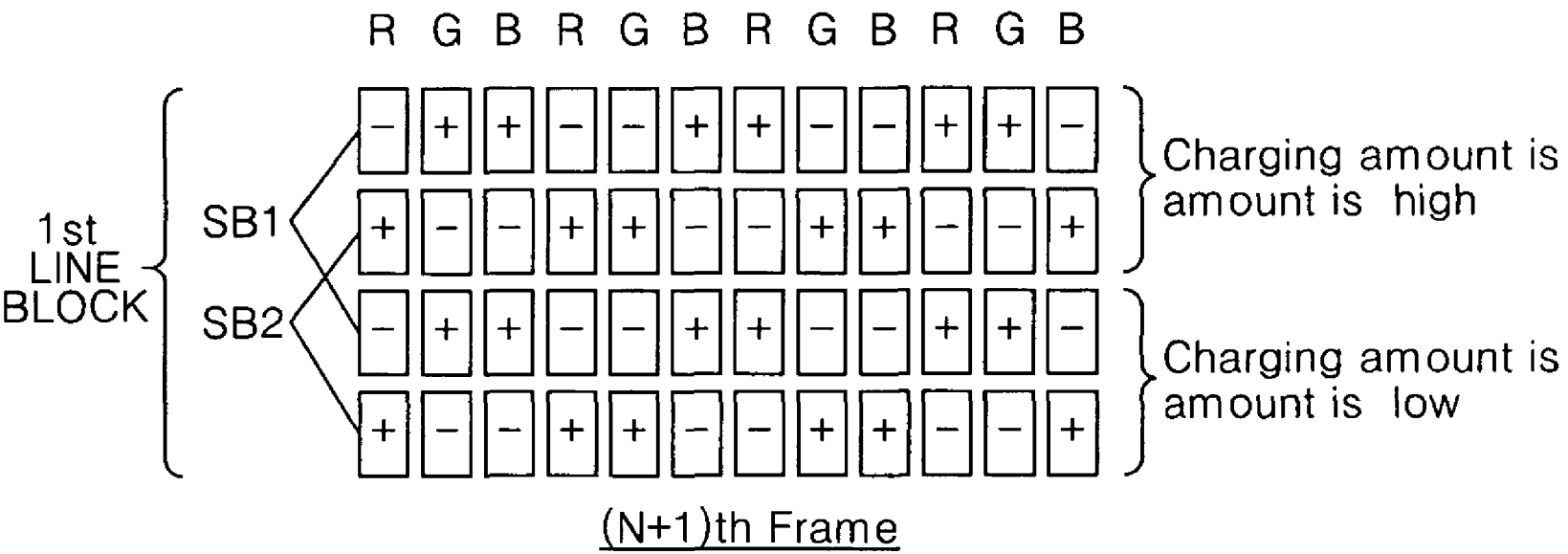
FIG. 9 is a diagram showing polarities and a charge amount of a data voltage which is charged in liquid crystal cells by the driving waveform of FIG. 8.

For the (N+1)th frame period, if the data voltages are charged in the liquid crystal cells of the first line block in the scanning sequence as shown in FIG. 8, the liquid crystal display panel is driven by the horizontal two dots inversion method and the vertical one dot inversion method as shown in FIG. 9. For the (N+1)th frame period, if the scanning sequences of the first and second sub-blocks SB1 and SB2 are changed as shown in FIG. 8, the charge amounts of the third and fourth pixel rows are decreased in comparison with the charge amounts of the first and second pixel rows as shown in FIG. 9.

As can be seen in FIG. 7 and FIG. 9, pixel rows having a less charge amount in the (N)th frame period are changed to pixel rows having a relatively great charge amount in the (N+1)th frame period, and pixel rows having a great charge amount in the (N)th frame period are changed to pixel rows having a relatively great charge amount in the (N+1)th frame period to compensate a deviation of the charge amounts of all liquid crystal cells for the two frame periods.

In this way, in the liquid crystal display according to the embodiment of the present invention, each line block includes two sub-blocks which is charged with a data voltage having different polarities, and changes a scanning sequence of each sub block for each frame period to compensate the deviation of the charge amount. Accordingly, if the number of pixel rows, which is included in the sub-block, the number of frames where the charge amount is compensated is increased in order to shift the scanning sequence of each sub-block. For example, if the sub-block includes three pixel rows, the charge amount is compensated for three frame periods, and if the sub-block includes four pixel rows, the charge amount is compensated for four frame periods. Also, the sub-block includes five pixel rows, the charge amount is compensated for five frame periods, and if the sub-block includes six pixel rows, the charge amount is compensated for six frame periods.

FIG. 10 to FIG. 15 show an example that one line block is divided into the first and second sub-blocks which include the six pixel rows, respectively.

Figure 10:
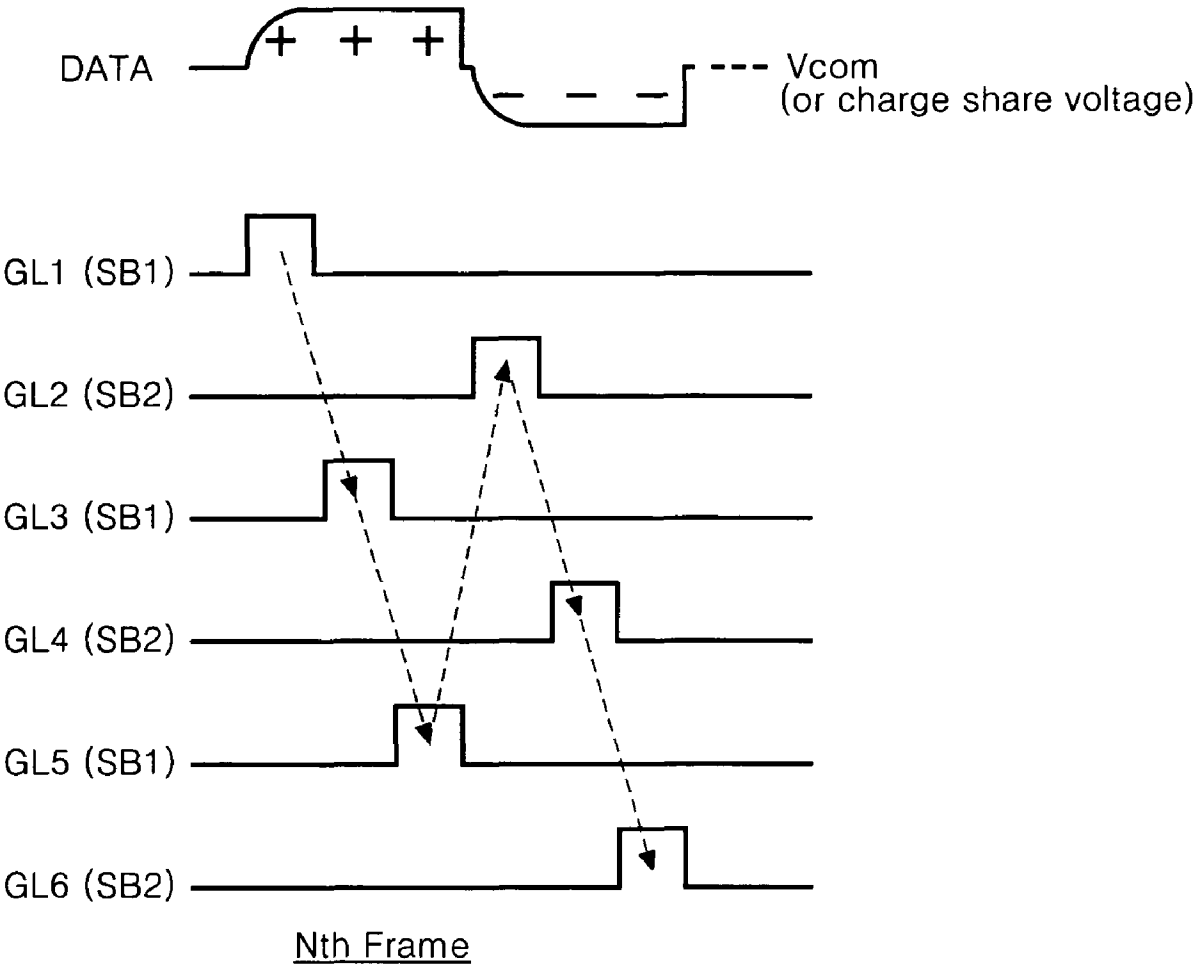
FIG. 10 is a waveform diagram showing a data and scanning pulses, which are generated for the (N)th frame period in the case where one line block includes six pixel rows in the liquid crystal display as shown in FIG. 5.

FIG. 10 shows scanning pulses and a data voltage which are supplied to the first and sixth gate lines GL1 to GL6 included in the first line block for the (N)th frame period.

Referring to FIG. 10, the gate driver 240 supplies the scanning pulses in a sequence of the first gate line GL1, the third gate line GL3, the fifth gate line GL5, the second gate line GL2, the fourth gate line GL4, and the sixth gate line GL6 at the first line block for the (N)th frame period. The gate driver 240 supplies the scanning pulse in a sequence from the first line block toward the (k)th line block for each frame period. The data driver 220 is synchronized with the scanning pulses, which are supplied to the first, third, and fifth gate lines GL1, GL3, and GL5, to output the data voltages of the first polarity pattern (+−−+ . . . +−−+) to be displayed to the first, third, and fifth pixel rows, and then is synchronized with the scanning pulses, which are supplied to the second, fourth, and sixth gate lines GL2, GL4, and GL6, to output the data voltage of the second polarity pattern (−++− . . . −++−) to be displayed to the second, fourth, and sixth pixel rows for the (N)th frame period. The data driver 220 inverts a polarity of a data voltage for each liquid crystal cell (one dot) in the pixel column in response to a polarity control signal POL which is inverted for each horizontal period for the (N)th frame period. The timing controller 210 supplies data, which are re-aligned by the data re-aligner 230, to the data driver 220 in a sequence of the data of the first pixel row, the data of the third pixel row, the data of the fifth pixel row, the data of the second pixel row, the data of the fourth pixel row, and the data of the sixth pixel row for the (N)th frame period.

For the (N)th frame period, the first sub-block SB1 includes the first, third, and fifth pixel rows that charge the data voltage having the first polarity pattern (+−−+ . . . +−−+), and is selected by the scanning pulses which are supplied to the first, third, and fifth gate lines GL1, GL3, and GL5. For the (N)th frame period, the second sub-block SB2 includes the second, fourth, and sixth pixel rows that charge the data voltage having the second polarity pattern (−++− . . . −++−), and is selected by the scanning pulses which are supplied to the second, fourth, and sixth gate lines GL2, GL4, and GL6.

Figure 11:
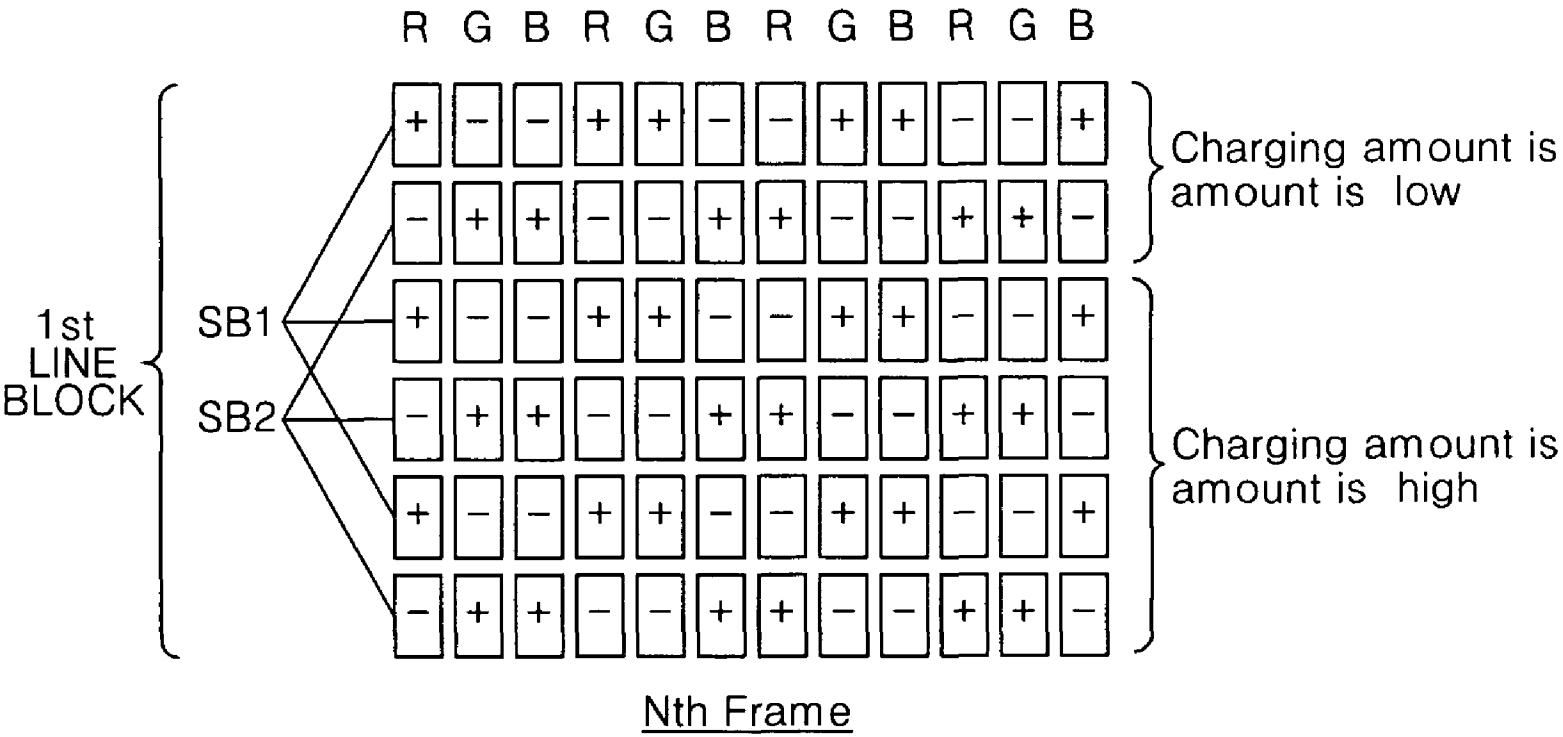
FIG. 11 is a diagram showing polarities and a charge amount of a data voltage which is charged in liquid crystal cells by the driving waveform of FIG. 10.

For the (N)th frame period, if the data voltages are charged in the liquid crystal cells of the first line block in the scanning sequence as shown in FIG. 10, the liquid crystal display panel is driven by the horizontal two dots inversion method and the vertical one dot inversion method as shown in FIG. 11. However, if the data voltages are scanned in the scanning sequence as shown in FIG. 10, the charge amounts of the first and second pixel rows become less than the charge amounts of the third and fourth pixel rows as shown in FIG. 11. This is caused by a fact that a data voltage of the first pixel row that is firstly charged in comparison with the third and fifth pixel rows among three data voltages, which are continuously outputted to the data lines DL1 to DLm to be charged in the first, third, fifth pixel rows, is lowered by a RC delay for three horizontal periods as shown in FIG. 10. In the same manner, this is caused by a fact that a data voltage of the second pixel row that is firstly charged in comparison with the fourth and sixth pixel rows among three data voltages, which are continuously outputted to the data lines DL1 to DLm to be charged in the second, fourth, and sixth pixel rows, is lowered by a RC delay for the three horizontal periods.

The liquid crystal display according to the embodiment of the present invention shifts the scanning sequence of the first and second sub-blocks SB1 and SB2 to compensate the deviation of the charge amount for the three frame periods.

Figure 12:
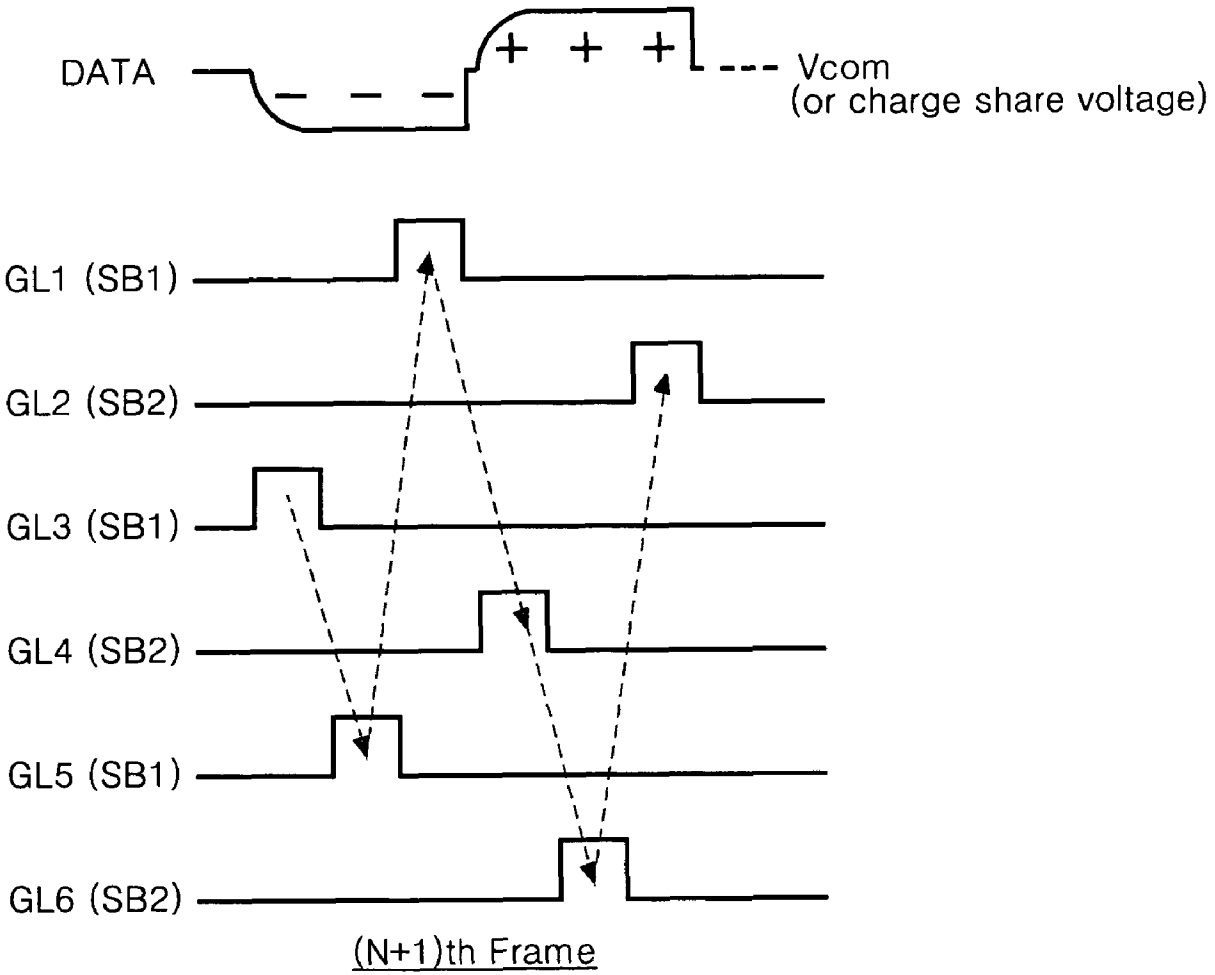
FIG. 12 is a waveform diagram showing a data and scanning pulses, which are generated for the (N+1)th frame period in the case where one line block includes six pixel rows in the liquid crystal display as shown in FIG. 5.

FIG. 12 shows a scanning pulse and data voltages which drive the first line block including the six pixel rows for the (N+1)th frame period.

Referring to FIG. 12, the gate driver 240 supplies the scanning pulses in a sequence of the third gate line GL3, the fifth gate line GL5, the first gate line GL1, the fourth gate line GL4, the sixth gate line GL6, and the second gate line GL2 at the first line block for the (N+1)th frame period. The data driver 220 is synchronized with the scanning pulses, which are supplied to the third, fifth, and first gate lines GL3, GL5, and GL1, to output the data voltages of the second polarity pattern (−++− . . . −++−) to be displayed to the third, fifth, and first pixel rows, and then is synchronized with the scanning pulses, which are supplied to the fourth, sixth, and second gate lines GL4, GL6, and GL2, to output the data voltage of the first polarity pattern (+−−+ . . . +−−+) to be displayed to the fourth, sixth, and second pixel rows for the (N+1)th frame period. The data driver 220 inverts a polarity of a data voltage for each liquid crystal cell (one dot) in the pixel column in response to a polarity control signal POL which is inverted for each horizontal period for the (N+1)th frame period. The timing controller 210 supplies data, which are re-aligned by the data re-aligner 230, to the data driver 220 in a sequence of the data of the third pixel row, the data of the fifth pixel row, the data of the first pixel row, the data of the fourth pixel row, the data of the sixth pixel row, and the data of the second pixel row for the (N+1)th frame period.

For the (N+1)th frame period, the first sub-block SB1 includes the third, fifth, and first pixel rows that charge the data voltage having the second polarity pattern (−++− . . . −++−), and is selected by the scanning pulses which are supplied to the third, fifth, and first gate lines GL3, GL5, and GL1. For the (N+1)th frame period, the second sub-block SB2 includes the fourth, sixth, second pixel rows that charge the data voltage having the first polarity pattern (+−−+ . . . +−−+), and is selected by the scanning pulses which are supplied to the fourth, sixth, second gate lines GL4, GL6, and GL2.

Figure 13:
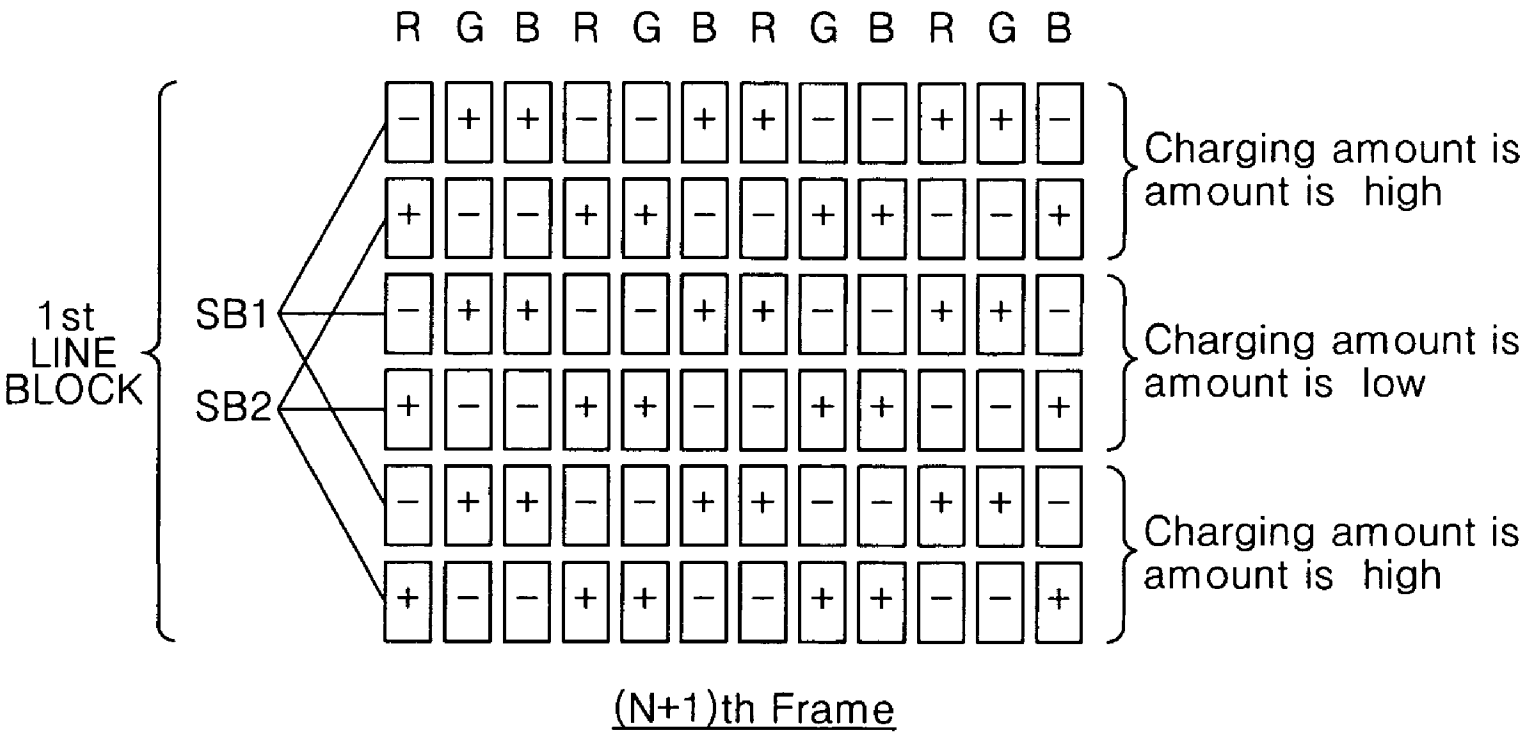
FIG. 13 is a diagram showing polarities and a charge amount of a data voltage which is charged in liquid crystal cells by the driving waveform of FIG. 12.

For the (N+1)th frame period, if the data voltages are charged in the liquid crystal cells of the first line block in the scanning sequence as shown in FIG. 12, the liquid crystal display panel is driven by the horizontal two dots inversion method and the vertical one dot inversion method as shown in FIG. 13. Also, the charge amounts of the third and fourth pixel rows become less than the charge amounts of the first, second, fifth, and sixth pixel rows as shown in FIG. 13. This is caused by a fact that a data voltage of the third pixel row that is firstly charged in comparison with the first and fifth pixel rows among three data voltages, which are continuously outputted to the data lines DL1 to DLm to be charged in the first, third, fifth pixel rows, is lowered by a RC delay for three horizontal periods as shown in FIG. 12. In the same manner, this is caused by a fact that a data voltage of the fourth pixel row that is firstly charged in comparison with the second and sixth pixel rows among three data voltages, which are continuously outputted to the data lines DL1 to DLm to be charged in the second, fourth, and sixth pixel rows, is lowered by a RC delay for the three horizontal periods.

Figure 14:
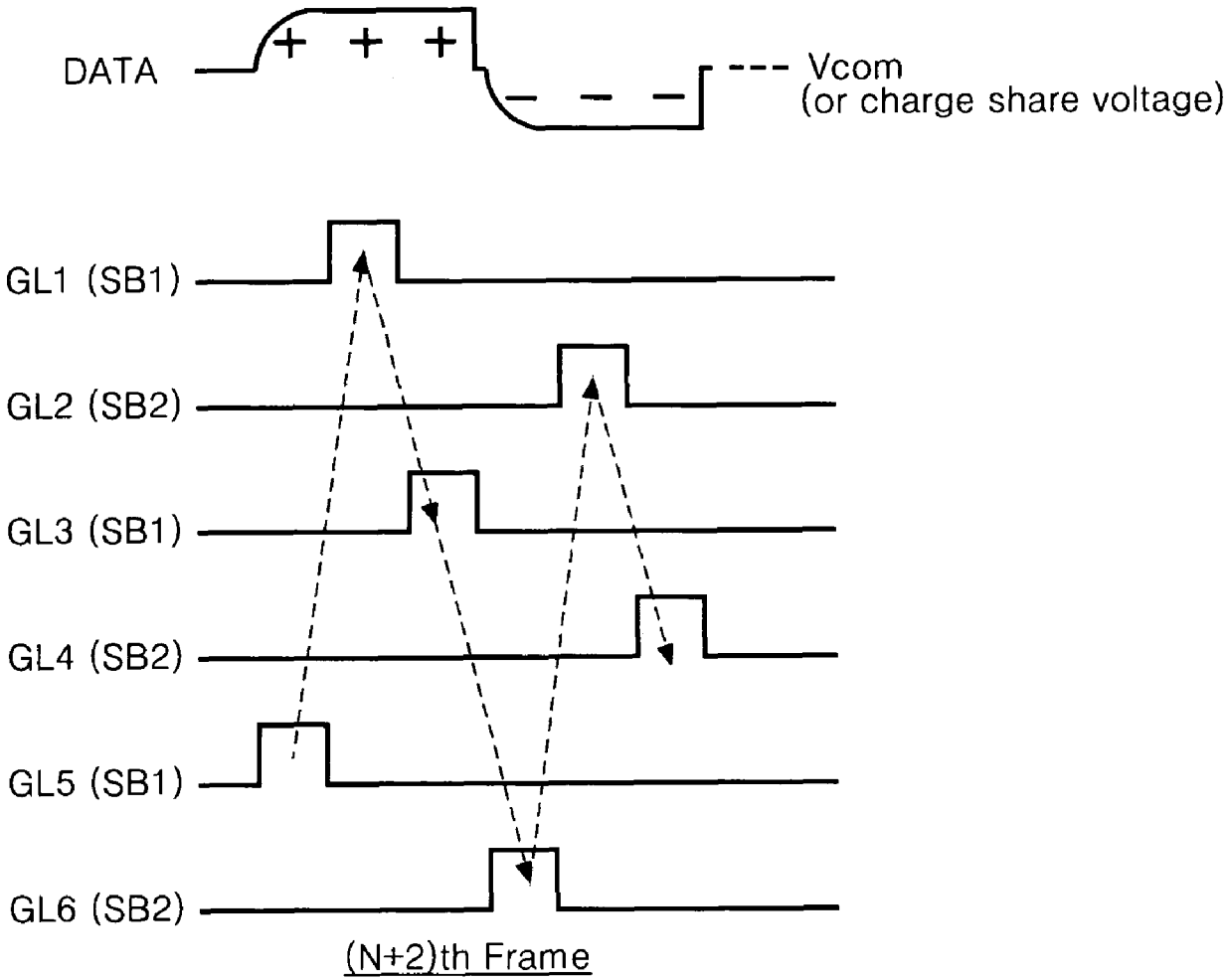
FIG. 14 is a waveform diagram showing a data and scanning pulses, which are generated for the (N+2)th frame period in the case where one line block includes six pixel rows in the liquid crystal display as shown in FIG. 5.

FIG. 14 shows a scanning pulse and data voltages which drive the first line block including the six pixel rows for the (N+2)th frame period.

Referring to FIG. 14, the gate driver 240 supplies the scanning pulses in a sequence of the fifth gate line GL5, the first gate line GL1, the third gate line GL3, the sixth gate line GL6, the second gate line GL2, and the fourth gate line GL4 at the first line block for the (N+2)th frame period. The data driver 220 is synchronized with the scanning pulses, which are supplied to the fifth, first, and third gate lines GL5, GL1, and GL3, to output the data voltages of the first polarity pattern (+−−+ . . . +−−+) to be displayed to the fifth, first, and third pixel rows, and then is synchronized with the scanning pulses, which are supplied to the sixth, second, and fourth gate lines GL6, GL2, and GL4, to output the data voltage of the second polarity pattern (−++− . . . −++−) to be displayed to the sixth, second, and fourth pixel rows for the (N+2)th frame period. The data driver 220 inverts a polarity of a data voltage for each liquid crystal cell (one dot) in the pixel column in response to a polarity control signal POL which is inverted for each horizontal period for the (N+2)th frame period. The timing controller 210 supplies data, which are re-aligned by the data re-aligner 230, to the data driver 220 in a sequence of the data of the fifth pixel row, the data of the first pixel row, the data of the third pixel row, the data of the sixth pixel row, the data of the second pixel row, and the data of the fourth pixel row for the (N+2)th frame period.

For the (N+2)th frame period, the first sub-block SB1 includes the fifth, first, and third pixel rows that charge the data voltage having the first polarity pattern (+−−+ . . . +−−+), and is selected by the scanning pulses which are supplied to the fifth, first, and third gate lines GL5, GL1, and GL3. For the (N+2)th frame period, the second sub-block SB2 includes the sixth, second, and fourth pixel rows that charge the data voltage having the second polarity pattern (−++− . . . −++−), and is selected by the scanning pulses which are supplied to the sixth, second, and fourth gate lines GL6, GL2, and GL4.

Figure 15:
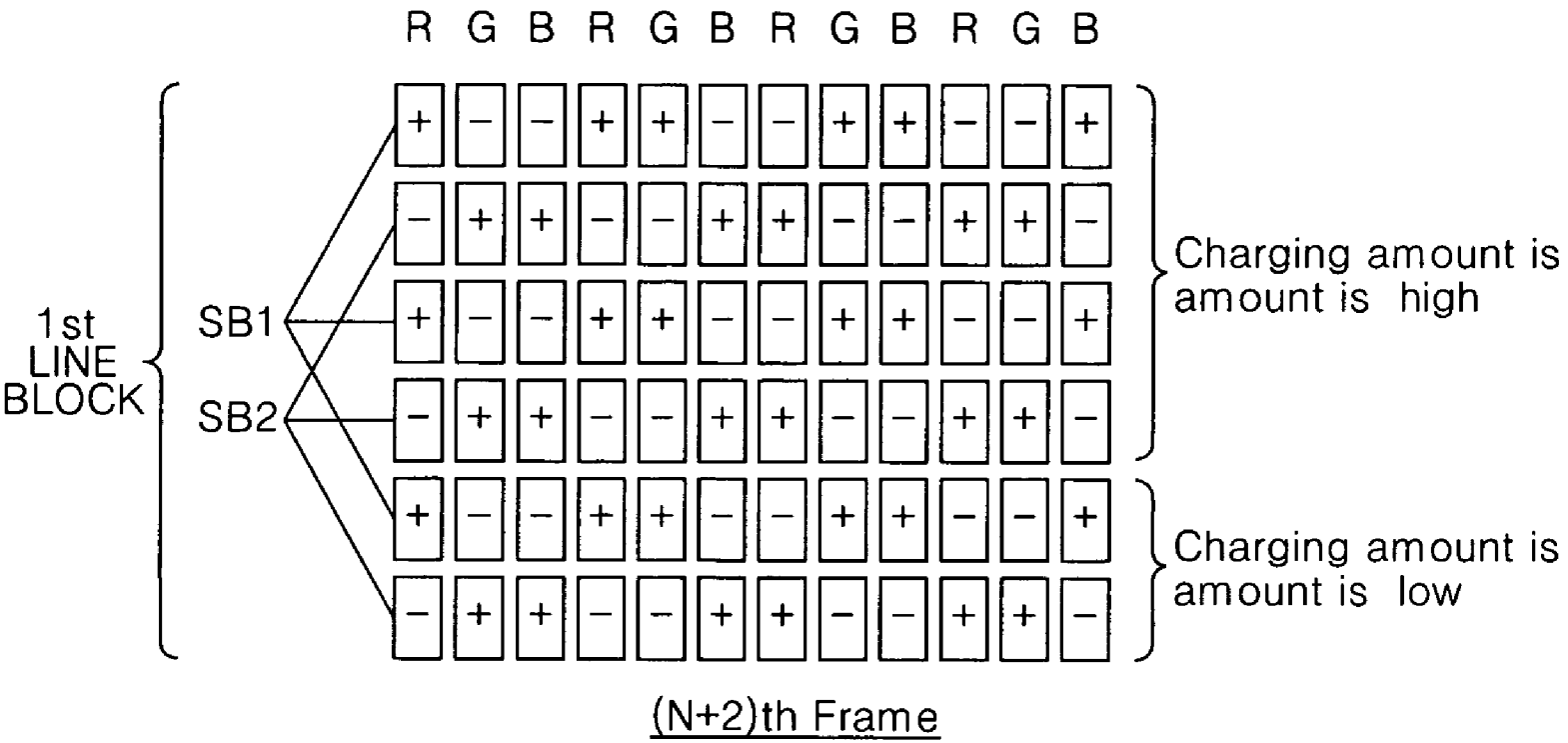
FIG. 15 is a diagram showing polarities and a charge amount of a data voltage which is charged in liquid crystal cells by the driving waveform of FIG. 14.

For the (N+2)th frame period, if the data voltages are charged in the liquid crystal cells of the first line block in the scanning sequence as shown in FIG. 14, the liquid crystal display panel is driven by the horizontal two dots inversion method and the vertical one dot inversion method as shown in FIG. 15. Also, the charge amounts of the fifth and sixth pixel rows become less than the charge amounts of the first and fourth pixel rows as shown in FIG. 15. This is caused by a fact that a data voltage of the fifth pixel row that is firstly charged in comparison with the first and third pixel rows among three data voltages, which are continuously outputted to the data lines DL1 to DLm to be charged in the first, third, fifth pixel rows, is lowered by a RC delay for three horizontal periods as shown in FIG. 14. In the same manner, this is caused by a fact that a data voltage of the sixth pixel row that is firstly charged in comparison with the second and fourth pixel rows among three data voltages, which are continuously outputted to the data lines DL1 to DLm to be charged in the second, fourth, and sixth pixel rows, is lowered by a RC delay for the three horizontal periods.

Accordingly, as can be seen in FIG. 11, FIG. 13, and FIG. 15, the charge amounts of all pixel rows become uniform for the three frame periods.

In the case where one line block includes the six pixel rows, the scanning sequence that realizes the horizontal two dots inversion method and the vertical one dot inversion method and uniformly compensates the charge amount is not limited to the embodiments of FIG. 10 to FIG. 15. For example, applicable other embodiments of the present invention are as follows in the case where one line block includes the six pixel rows. One of such examples, the first line block may be scanned in a sequence of the first gate line G1, the third gate line G3, the fifth gate line G5, the fourth gate line G4, the sixth gate line G6, and the second gate line G2 for the (N)th frame period. Also, the first line block may be scanned in a sequence of the third gate line G3, the fifth gate line G5, the first gate line G1, the sixth gate line G6, the second gate line G2, and the fourth gate line G4 for the (N+1)th frame period. Furthermore, the first line block may be scanned in a sequence of the fifth gate line G5, the first gate line G1, the third gate line G3, the second gate line G2, the fourth gate line G4, and the sixth gate line G6 for the (N+2)th frame period. As a result, the first line block may be scanned for the three frame periods. For another example, the first line block may be scanned in a sequence of the first gate line G1, the third gate line G3, the fifth gate line G5, the sixth gate line G6, the second gate line G2, and the fourth gate line G4 for the (N)th frame period. Also, the first line block may be scanned in a sequence of the third gate line G3, the fifth gate line G5, the first gate line G1, the second gate line G2, the fourth gate line G4, and the sixth gate line G6 for the (N+1)th frame period. Furthermore, the first line block may be scanned in a sequence of the fifth gate line G5, the first gate line G1, the third gate line G3, the fourth gate line G4, the sixth gate line G6, and the second gate line G2 for the (N+2)th frame period. As a result, the first line block may be scanned for the three frame periods.

FIG. 16 to FIG. 23 show an example that one line block is divided into the first and second sub-blocks which include the eight pixel rows, respectively.

Figure 16:
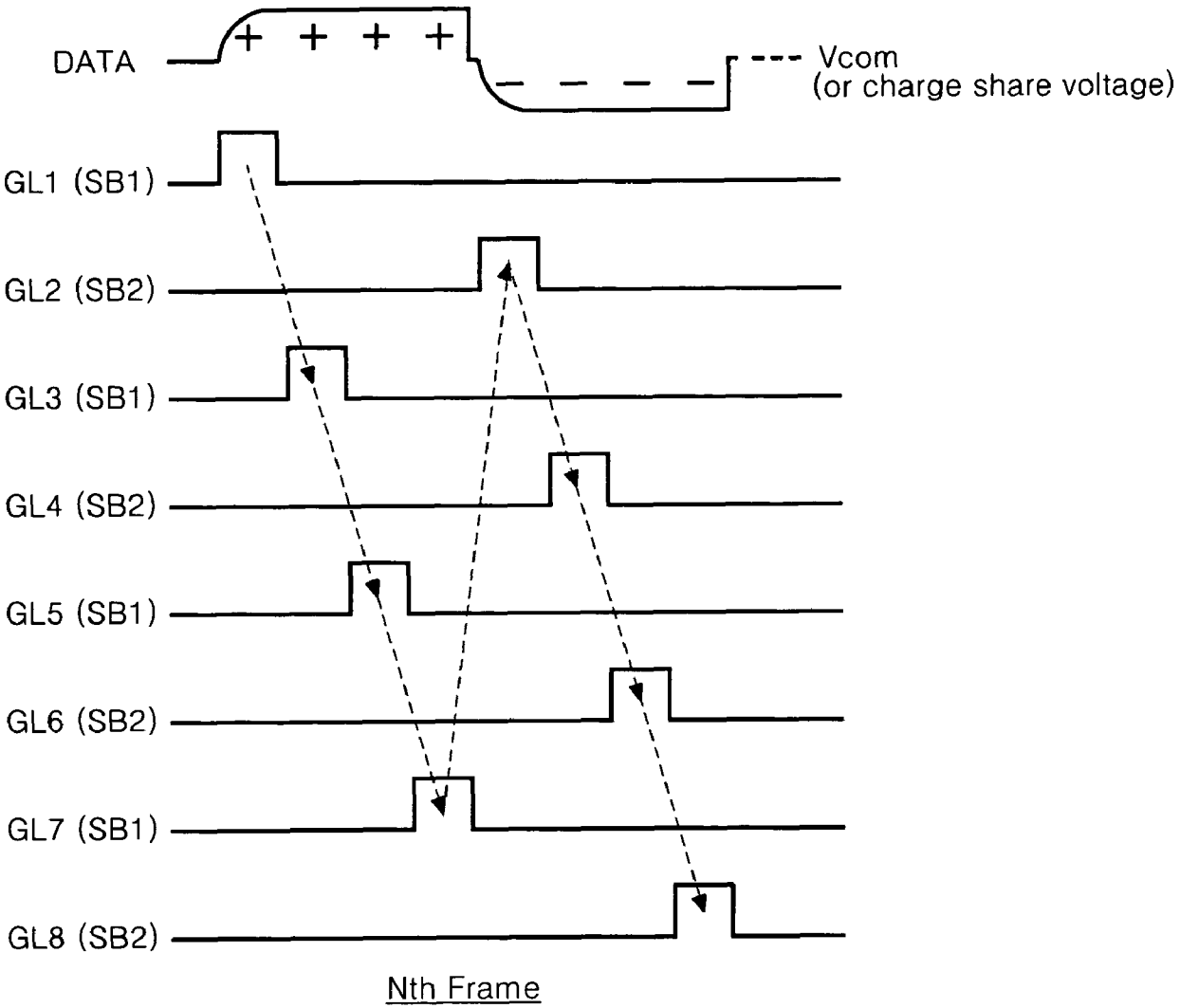
FIG. 16 is a waveform diagram showing a data and scanning pulses, which are generated for the (N)th frame period in the case where one line block includes eight pixel rows in the liquid crystal display as shown in FIG. 5.

FIG. 16 shows scanning pulses and a data voltage which are supplied to the first and eight gate lines GL1 to GL8 included in the first line block for the (N)th frame period.

Referring to FIG. 16, the gate driver 240 supplies the scanning pulses in a sequence of the first gate line GL1, the third gate line GL3, the fifth gate line GL5, the seventh gate line GL7, the second gate line GL2, the fourth gate line GL4, the sixth gate line GL6, and the eighth gate line GL8 at the first line block for the (N)th frame period. The gate driver 240 supplies the scanning pulse in a sequence from the first line block toward the (k)th line block for each frame period. The data driver 220 is synchronized with the scanning pulses, which are supplied to the first, third, fifth, and seventh gate lines GL1, GL3, GL5, and GL7, to output the data voltages of the first polarity pattern (+−−+ . . . +−−+) to be displayed to the first, third, fifth, and seventh pixel rows, and then is synchronized with the scanning pulses, which are supplied to the second, fourth, sixth, and eighth gate lines GL2, GL4, GL6, and GL8, to output the data voltage of the second polarity pattern (−++− . . . −++−) to be displayed to the second, fourth, sixth, and eighth pixel rows for the (N)th frame period. The data driver 220 inverts a polarity of a data voltage for each liquid crystal cell (one dot) in the pixel column in response to a polarity control signal POL which is inverted for each horizontal period for the (N)th frame period. The timing controller 210 supplies data, which are re-aligned by the data re-aligner 230, to the data driver 220 in a sequence of the data of the first pixel row, the data of the third pixel row, the data of the fifth pixel row, the data of the seventh pixel row, the data of the second pixel row, the data of the fourth pixel row, the data of the sixth pixel row, and the data of the eighth pixel row for the (N)th frame period.

For the (N)th frame period, the first sub-block SB1 includes the first, third, fifth, and seventh pixel rows that charge the data voltage having the first polarity pattern (+−−+ . . . +−−+), and is selected by the scanning pulses which are supplied to the first, third, fifth, and seventh gate lines GL1, GL3, GL5, and GL7. For the (N)th frame period, the second sub-block SB2 includes the second, fourth, sixth, and eighth pixel rows that charge the data voltage having the second polarity pattern (−++− . . . −++−), and is selected by the scanning pulses which are supplied to the second, fourth, sixth, and eighth gate lines GL2, GL4, GL6, and GL8.

Figure 17:
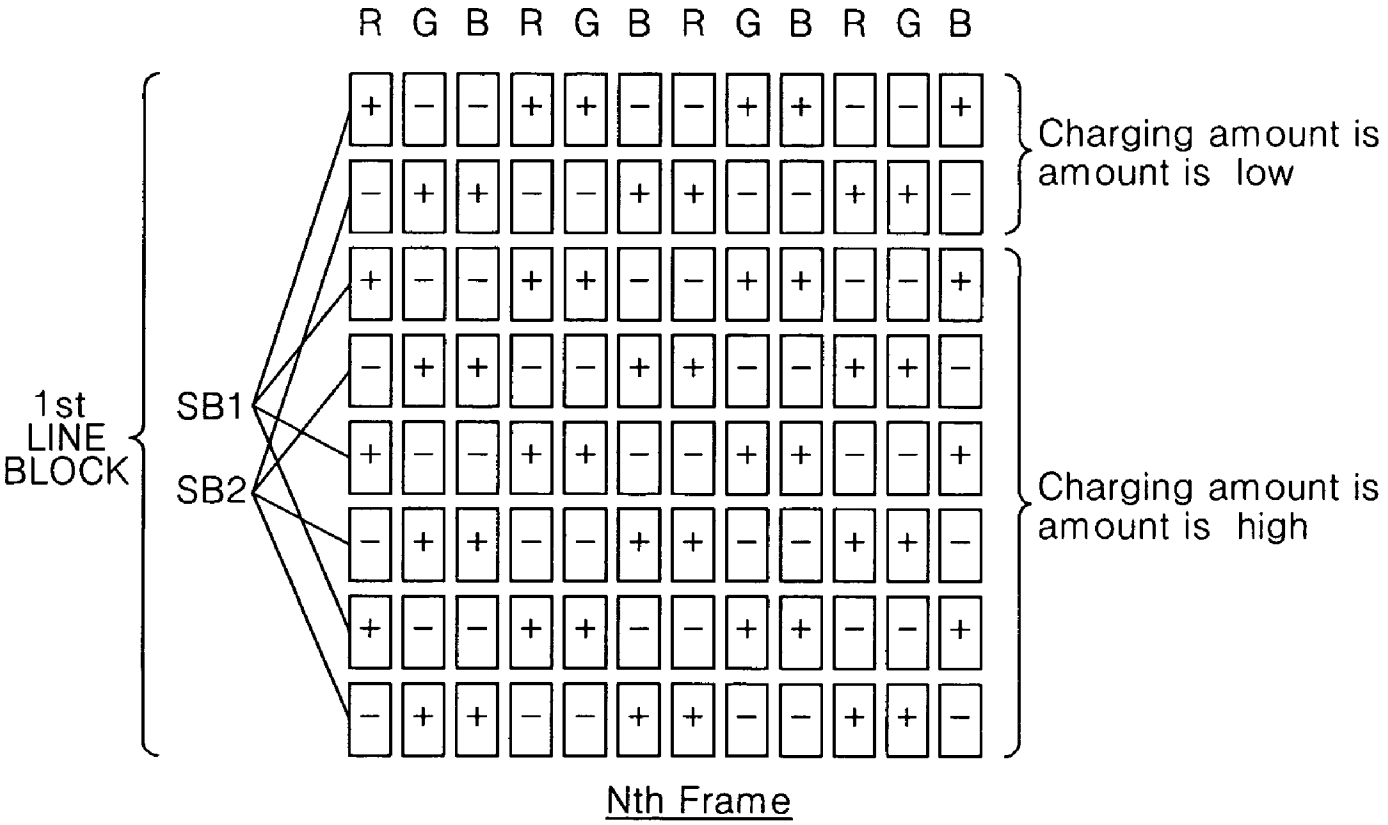
FIG. 17 is a diagram showing polarities and a charge amount of a data voltage which is charged in liquid crystal cells by the driving waveform of FIG. 16.

For the (N)th frame period, if the data voltages are charged in the liquid crystal cells of the first line block in the scanning sequence as shown in FIG. 16, the liquid crystal display panel is driven by the horizontal two dots inversion method and the vertical one dot inversion method as shown in FIG. 17. However, if the data voltages are scanned in the scanning sequence as shown in FIG. 16, the charge amounts of the first and second pixel rows become less than the charge amounts of the third to eighth pixel rows as shown in FIG. 17. This is caused by a fact that a data voltage of the first pixel row that is firstly charged in comparison with the third, fifth, and seventh pixel rows among four data voltages, which are continuously outputted to the data lines DL1 to DLm to be charged in the first, third, fifth, and seventh pixel rows, is lowered by a RC delay for fourth horizontal periods as shown in FIG. 16. In the same manner, this is caused by a fact that a data voltage of the second pixel row that is firstly charged in comparison with the fourth, sixth, and eighth pixel rows among four data voltages, which are continuously outputted to the data lines DL1 to DLm to be charged in the second, fourth, sixth, and eighth pixel rows, is lowered by a RC delay for the four horizontal periods.

The liquid crystal display according to the embodiment of the present invention shifts the scanning sequence of the first and second sub-blocks SB1 and SB2 to compensate the deviation of the charge amount for the four frame periods.

Figure 18:
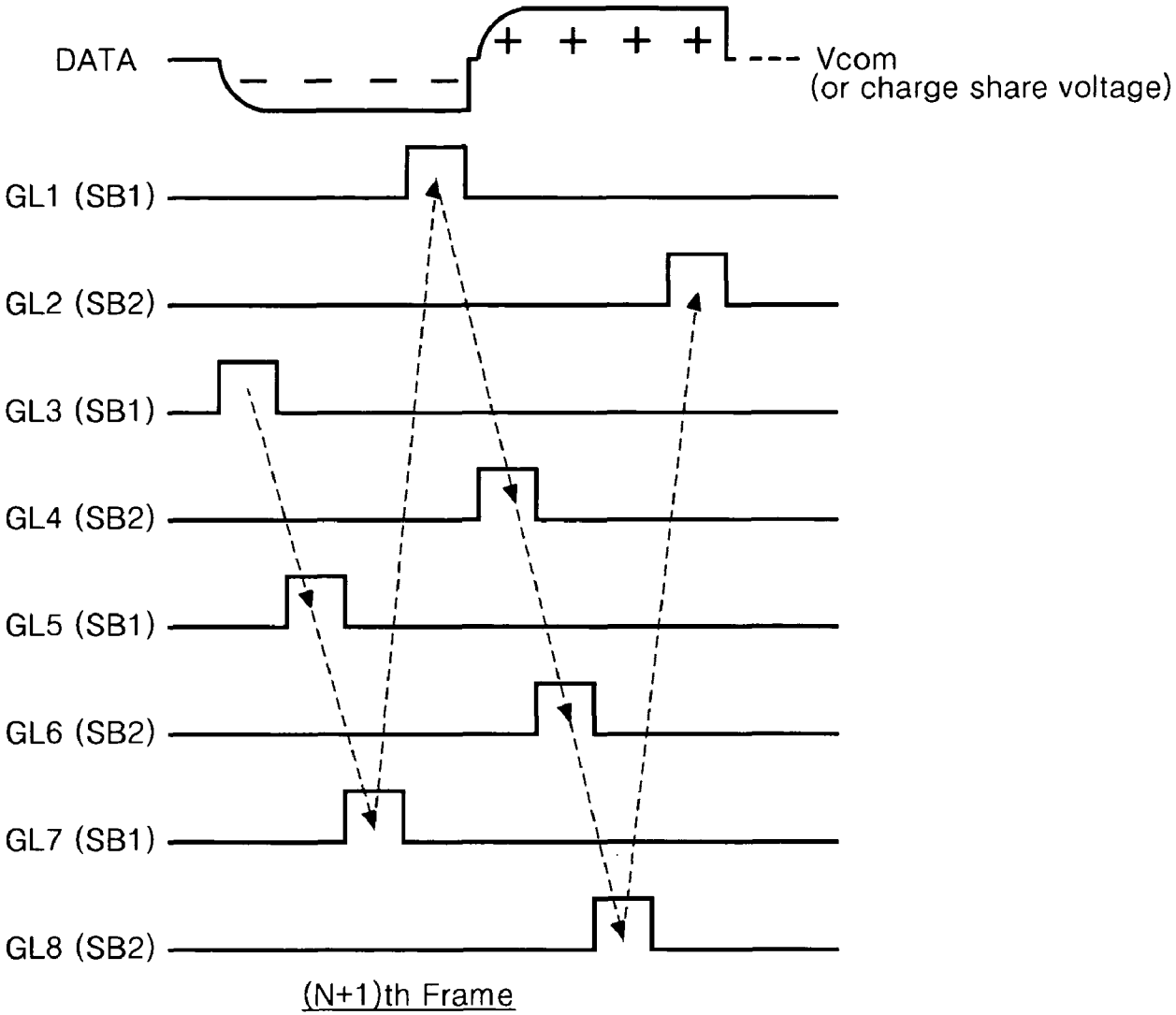
FIG. 18 is a waveform diagram showing a data and scanning pulses, which are generated for the (N+1)th frame period in the case where one line block includes eight pixel rows in the liquid crystal display as shown in FIG. 5.

FIG. 18 shows a scanning pulse and data voltages which drive the first line block including the eight pixel rows for the (N+1)th frame period.

Referring to FIG. 18, the gate driver 240 supplies the scanning pulses in a sequence of the third gate line GL3, the fifth gate line GL5, the seventh gate line GL7, the first gate line GL1, the fourth gate line GL4, the sixth gate line GL6, the eighth gate line GL8, and the second gate line GL2 at the first line clock for the (N+1)th frame period. The data driver 220 is synchronized with the scanning pulses, which are supplied to the third, fifth, seventh, and first gate lines GL3, GL5, GL7, and GL1, to output the data voltages of the second polarity pattern (−++− . . . −++−) to be displayed to the third, fifth, seventh, and first pixel rows, and then is synchronized with the scanning pulses, which are supplied to the fourth, sixth, eighth, and second gate lines GL4, GL6, GL8, and GL2, to output the data voltage of the first polarity pattern (+−−+ . . . +−−+) to be displayed to the fourth, sixth, eighth, and second pixel rows for the (N+1)th frame period. The data driver 220 inverts a polarity of a data voltage for each liquid crystal cell (one dot) in the pixel column in response to a polarity control signal POL which is inverted for each horizontal period for the (N+1)th frame period. The timing controller 210 supplies data, which are re-aligned by the data re-aligner 230, to the data driver 220 in a sequence of the data of the third pixel row, the data of the fifth pixel row, the data of the seventh pixel row, the data of the first pixel row, the data of the fourth pixel row, the data of the sixth pixel row, the data of the eighth pixel row, and the data of the second pixel row for the (N+1)th frame period.

For the (N+1)th frame period, the first sub-block SB1 includes the third, fifth, seventh, and first pixel rows that charge the data voltage having the second polarity pattern (−++− . . . −++−), and is selected by the scanning pulses which are supplied to the third, fifth, seventh, and first gate lines GL3, GL5, GL7, and GL1. For the (N+1)th frame period, the second sub-block SB2 includes the fourth, sixth, eighth, and second pixel rows that charge the data voltage having the first polarity pattern (+−−+ . . . +−−+), and is selected by the scanning pulses which are supplied to the fourth, sixth, eighth, and second gate lines GL4, GL6, GL8, and GL2.

Figure 19:
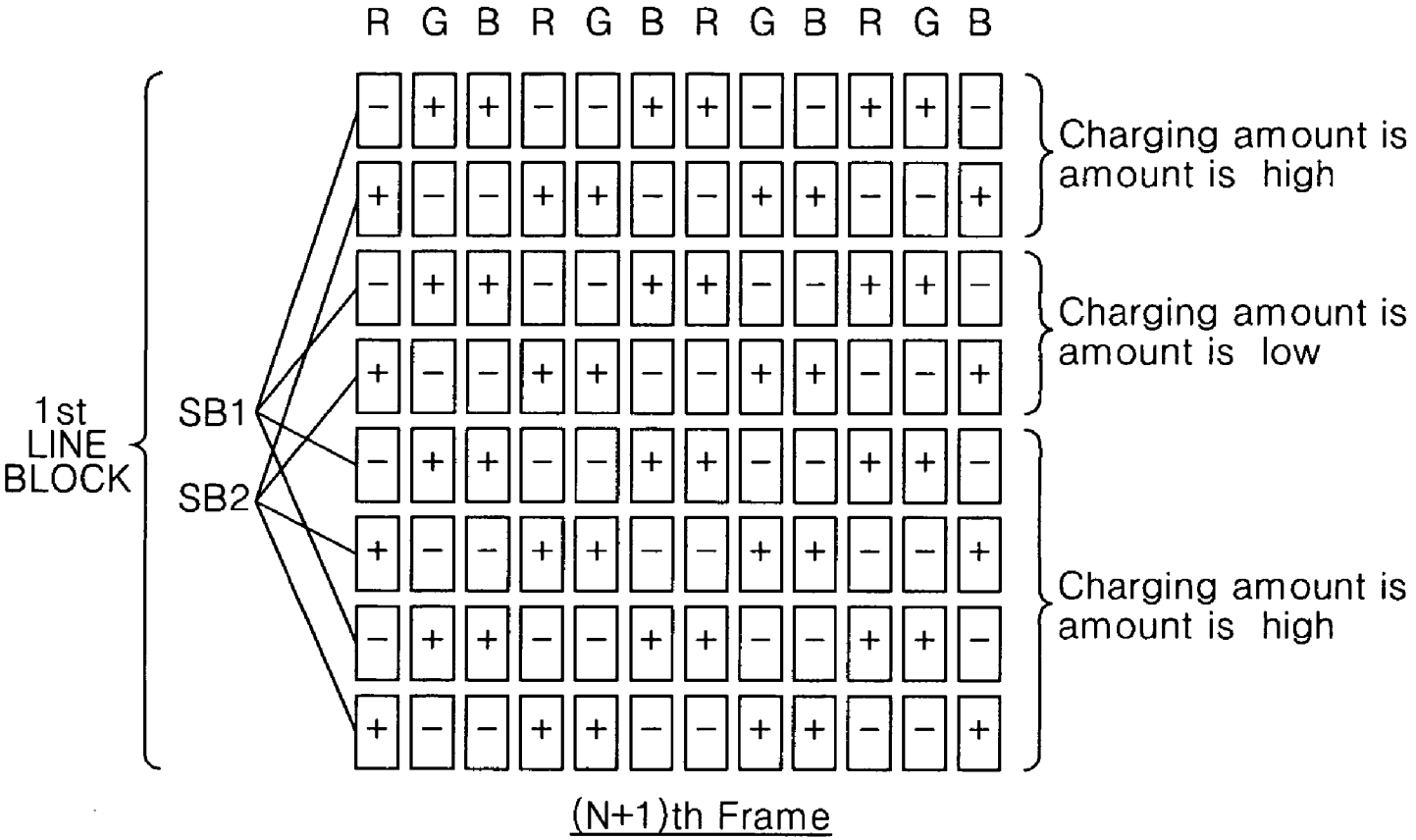
FIG. 19 is a diagram showing polarities and a charge amount of a data voltage which is charged in liquid crystal cells by the driving waveform of FIG. 18.

For the (N+1)th frame period, if the data voltages are charged in the liquid crystal cells of the first line block in the scanning sequence as shown in FIG. 18, the liquid crystal display panel is driven by the horizontal two dots inversion method and the vertical one dot inversion method as shown in FIG. 19. Also, the charge amounts of the third and fourth pixel rows become less than the charge amounts of the first and second pixel rows, and the fifth to the eighth pixel rows as shown in FIG. 19.

Figure 20:
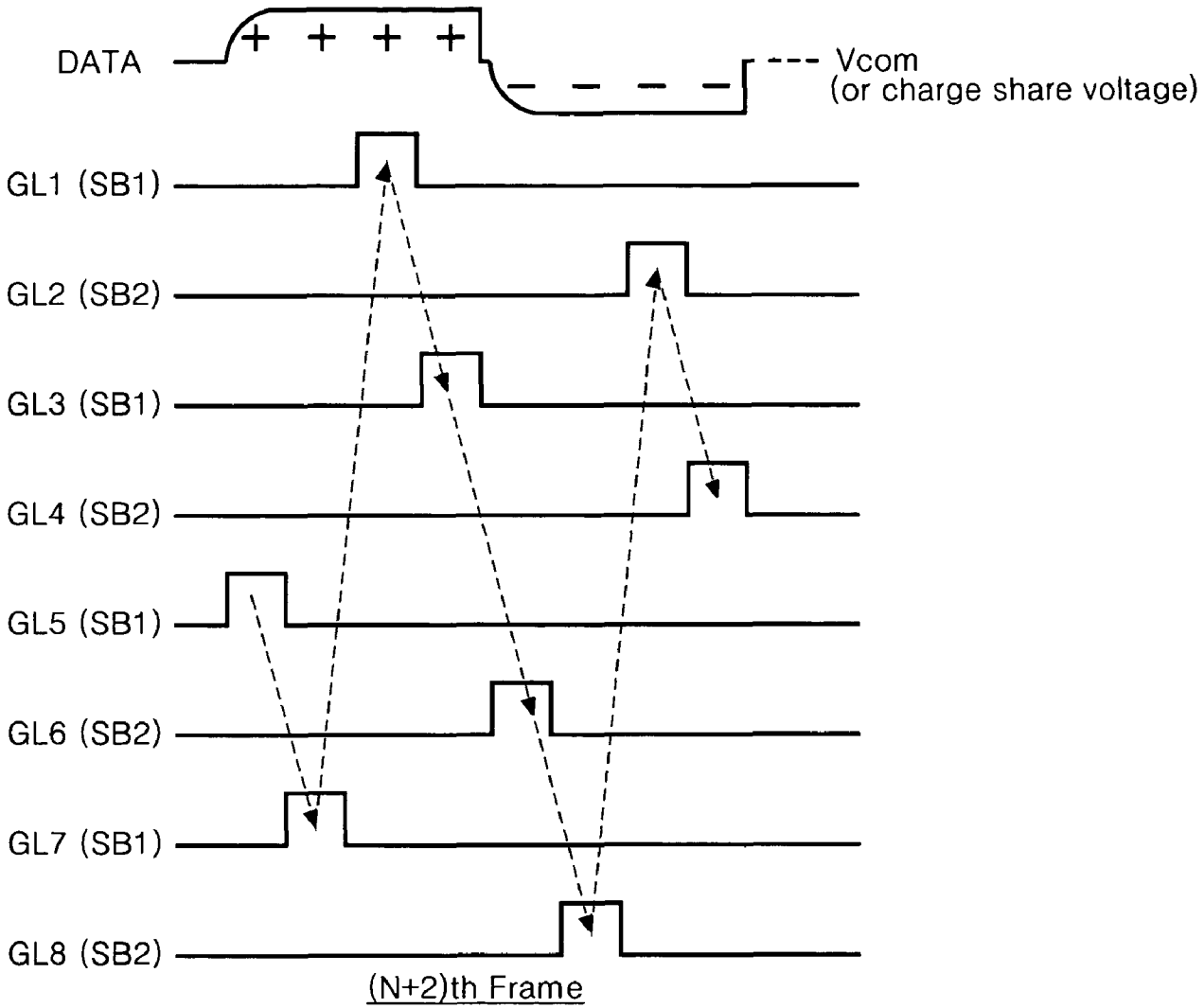
FIG. 20 is a waveform diagram showing a data and scanning pulses, which are generated for the (N+2)th frame period in the case where one line block includes eight pixel rows in the liquid crystal display as shown in FIG. 5.

FIG. 20 shows a scanning pulse and data voltages which drive the first line block including the eight pixel rows for the (N+2)th frame period.

Referring to FIG. 20, the gate driver 240 supplies the scanning pulses in a sequence of the fifth gate line GL5, the seventh gate line GL7, the first gate line GL1, the third gate line GL3, the sixth gate line GL6, the eighth gate line GL8, the second gate line GL2, and the fourth gate line GL4 at the first line block for the (N+2)th frame period. The data driver 220 is synchronized with the scanning pulses, which are supplied to the fifth, seventh, first, and third gate lines GL5, GL7, GL1, and GL3, to output the data voltages of the first polarity pattern (+−−+ . . . +−−+) to be displayed to the fifth, seventh, first, and third pixel rows, and then is synchronized with the scanning pulses, which are supplied to the sixth, eighth, second, and fourth gate lines GL6, GL8, GL2, and GL4, to output the data voltage of the second polarity pattern (−++− . . . −++−) to be displayed to the sixth, eighth, second, and fourth pixel rows for the (N+2)th frame period. The data driver 220 inverts a polarity of a data voltage for each liquid crystal cell (one dot) in the pixel column in response to a polarity control signal POL which is inverted for each horizontal period for the (N+2)th frame period. The timing controller 210 supplies data, which are re-aligned by the data re-aligner 230, to the data driver 220 in a sequence of the data of the fifth pixel row, the data of the seventh pixel row, the data of the first pixel row, the data of the third pixel row, the data of the sixth pixel row, the data of the eighth pixel row, the data of the second pixel row, and the data of the fourth pixel row for the (N+2)th frame period.

For the (N+2)th frame period, the first sub-block SB1 includes the fifth, seventh, first, and third pixel rows that charge the data voltage having the first polarity pattern (+−−+ . . . +−−+), and is selected by the scanning pulses which are supplied to the fifth, seventh, first, and third gate lines GL5, GL7, GL1, and GL3. For the (N+2)th frame period, the second sub-block SB2 includes the sixth, eighth, second, and fourth pixel rows that charge the data voltage having the second polarity pattern (−++− . . . −++−), and is selected by the scanning pulses which are supplied to the sixth, eighth, second, and fourth gate lines GL6, GL8, GL2, and GL4.

Figure 21:
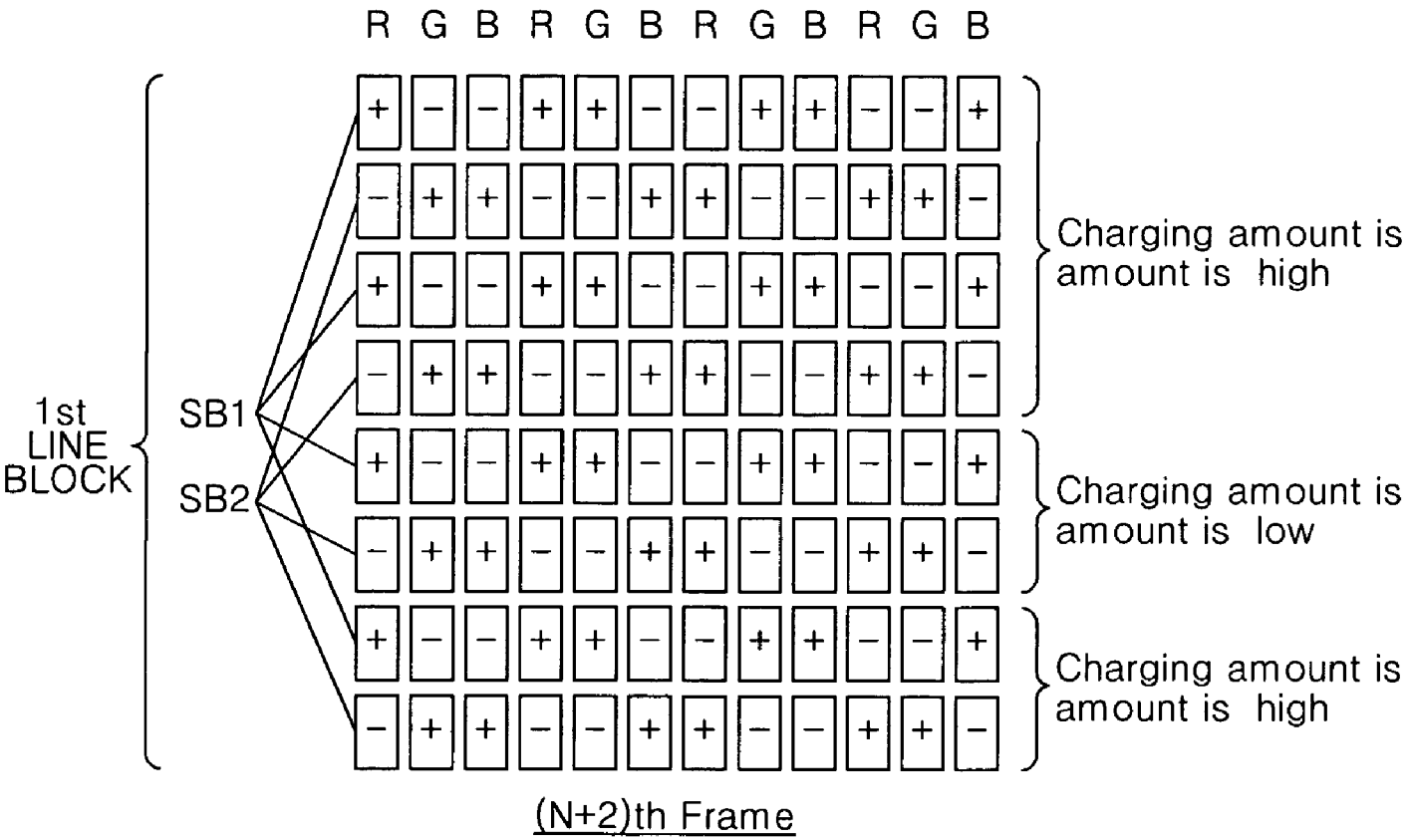
FIG. 21 is a diagram showing polarities and a charge amount of a data voltage which is charged in liquid crystal cells by the driving waveform of FIG. 20.

For the (N+2)th frame period, if the data voltages are charged in the liquid crystal cells of the first line block in the scanning sequence as shown in FIG. 20, the liquid crystal display panel is driven by the horizontal two dots inversion method and the vertical one dot inversion method as shown in FIG. 21. Also, the charge amounts of the fifth and sixth pixel rows become less than the charge amounts of the first to the fourth pixel rows, and the seventh and eighth pixel rows as shown in FIG. 21.

Figure 22:
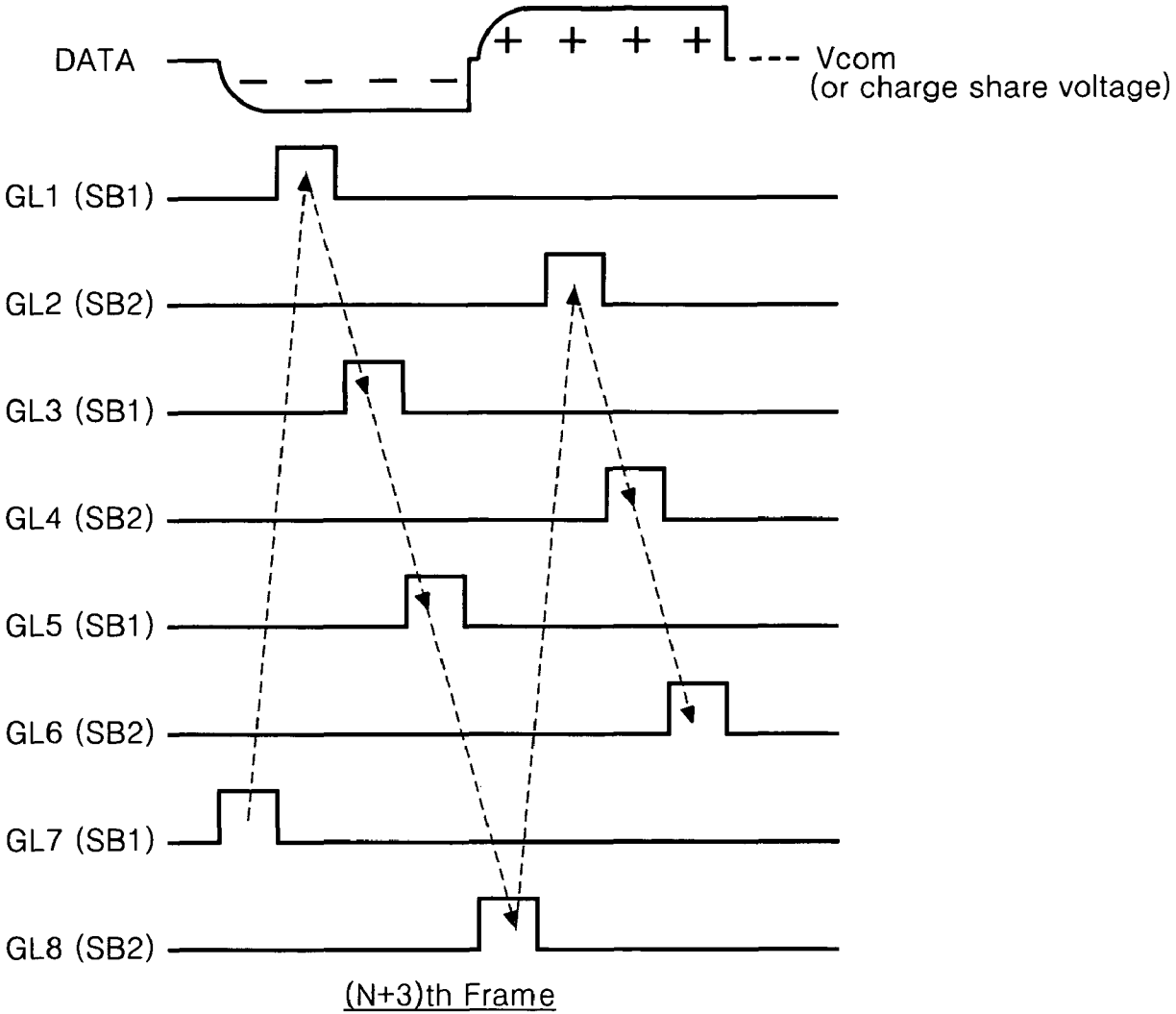
FIG. 22 is a waveform diagram showing a data and scanning pulses, which are generated for the (N+3)th frame period in the case where one line block includes eight pixel rows in the liquid crystal display as shown in FIG. 5.

FIG. 22 shows a scanning pulse and data voltages which drive the first line block including the eight pixel rows for the (N+3)th frame period.

Referring to FIG. 22, the gate driver 240 supplies the scanning pulses in a sequence of the seventh gate line GL7, the first gate line GL1, the third gate line GL3, the fifth gate line GL5, the eighth gate line GL8, the second gate line GL2, the fourth gate line GL4, and the sixth gate line GL6 at the first line block for the (N+3)th frame period. The data driver 220 is synchronized with the scanning pulses, which are supplied to the seventh, first, third, and fifth gate lines GL7, GL1, GL3, and GL5 to output the data voltages of the second polarity pattern (−++− . . . −++−) to be displayed to the seventh, first, third, and fifth pixel rows, and then is synchronized with the scanning pulses, which are supplied to the eighth, second, fourth, and sixth gate lines GL8, GL2, GL4, and GL6 to output the data voltage of the first polarity pattern (+−−+ . . . +−−+) to be displayed to the eighth, second, fourth, and sixth pixel rows for the (N+3)th frame period. The data driver 220 inverts a polarity of a data voltage for each liquid crystal cell (one dot) in the pixel column in response to a polarity control signal POL which is inverted for each horizontal period for the (N+3)th frame period. The timing controller 210 supplies data, which are re-aligned by the data re-aligner 230, to the data driver 220 in a sequence of the data of the seventh pixel row, the data of the first pixel row, the data of the third pixel row, the data of the fifth pixel row, the data of the eighth pixel row, the data of the second pixel row, the data of the fourth pixel row, and the data of the sixth pixel row for the (N+3)th frame period.

For the (N+3)th frame period, the first sub-block SB1 includes the seventh, first, third, and fifth pixel rows that charge the data voltage having the second polarity pattern (−++− . . . −++−), and is selected by the scanning pulses which are supplied to the seventh, first, third, and fifth gate lines GL7, GL1, GL3, and GL5. For the (N+3)th frame period, the second sub-block SB2 includes the eighth, second, fourth, and sixth pixel rows that charge the data voltage having the first polarity pattern (+−−+ . . . +−−+), and is selected by the scanning pulses which are supplied to the eighth, second, fourth, and sixth gate lines GL8, GL2, GL4, and GL6.

Figure 1:
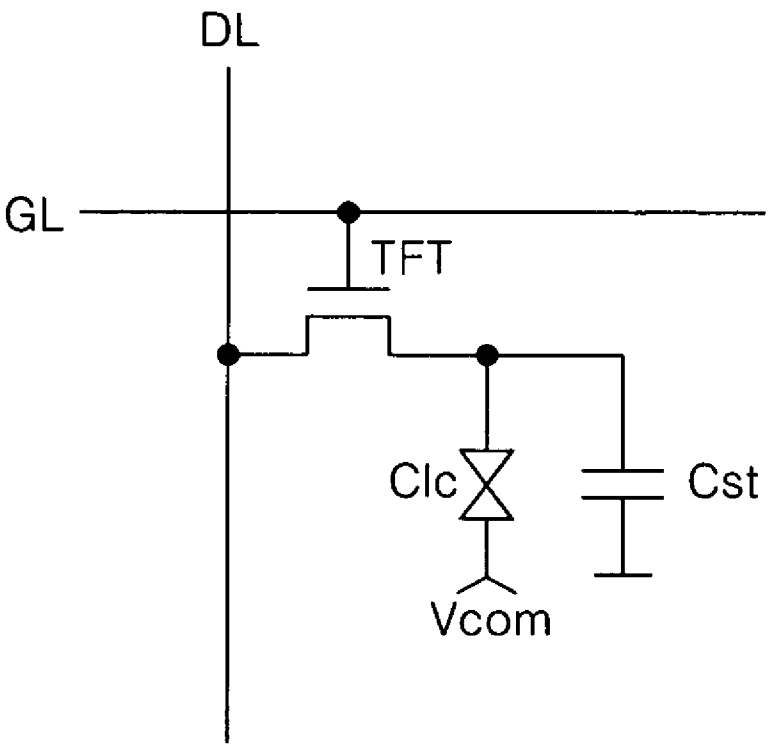
FIG. 1 RELATED ART
FIG. 1 is an equivalent circuit diagram showing a pixel provided at a liquid crystal display of the related art.
Figure 2:
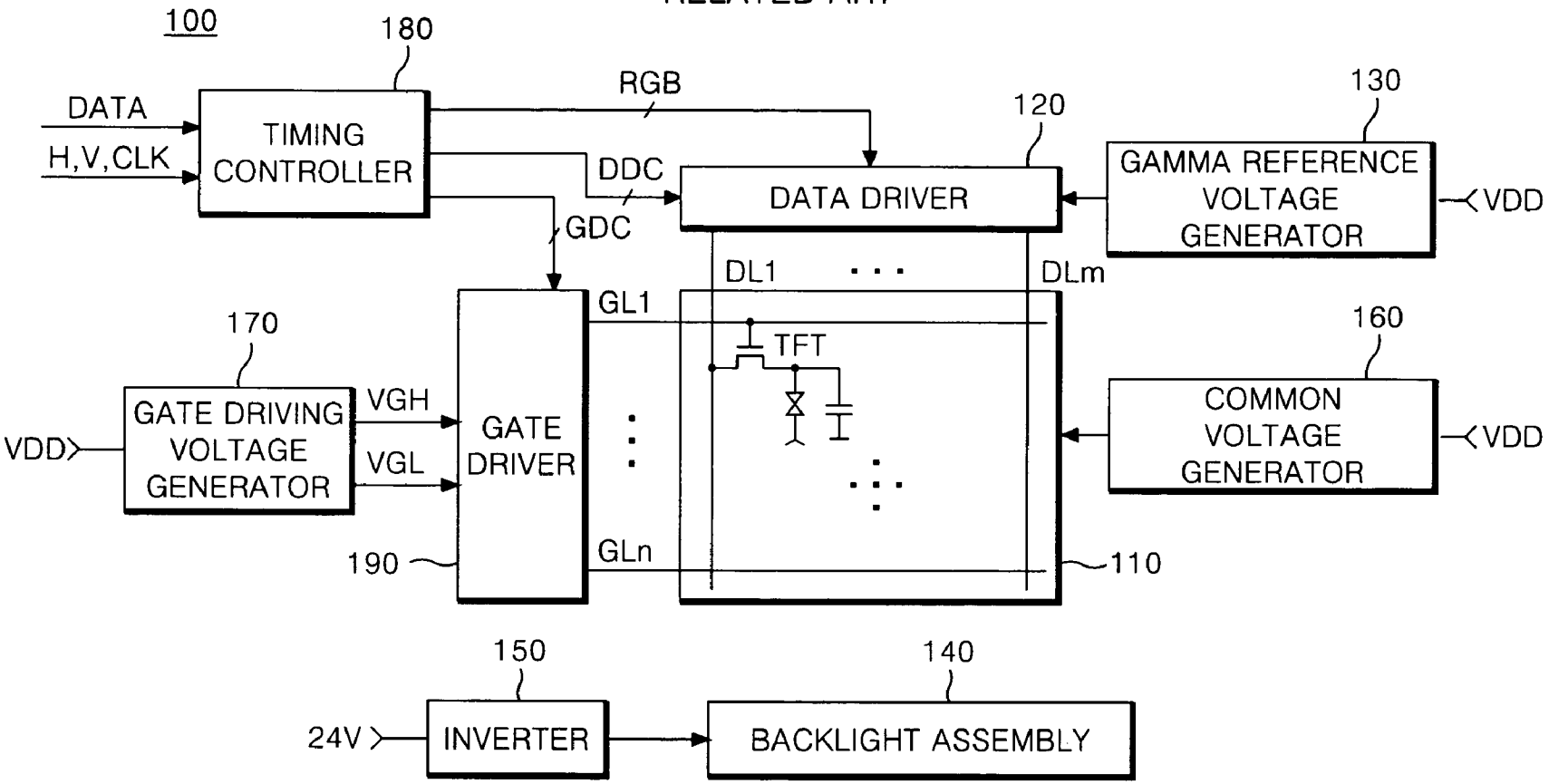
FIG.2 RELATED ART
FIG. 2 is a block diagram showing a configuration of the liquid crystal display of the related art.
Figure 4:
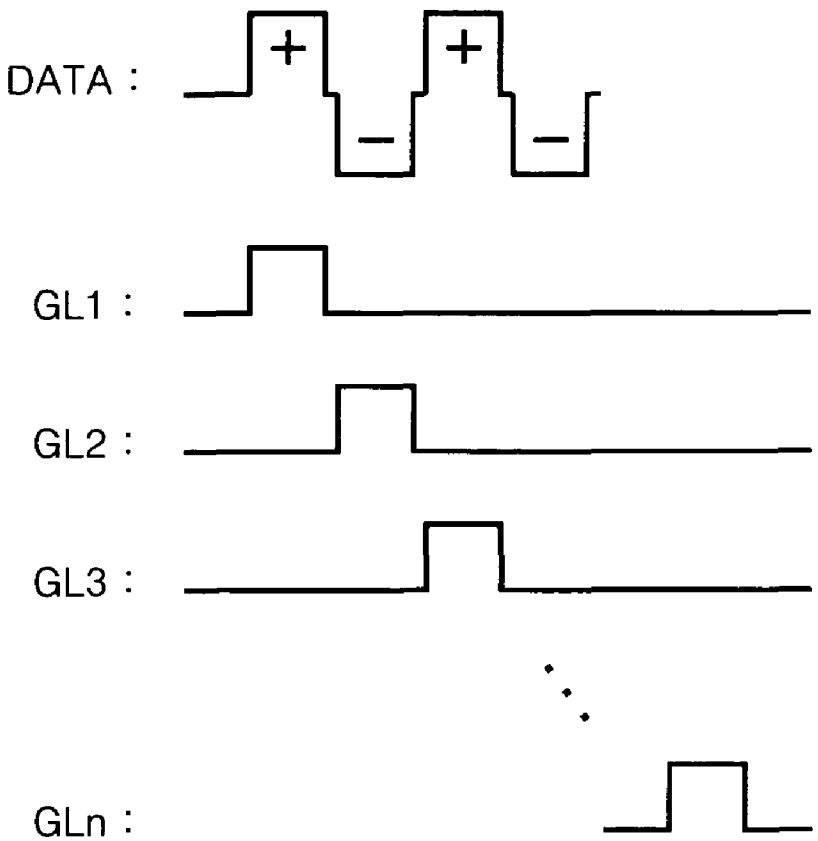
FIG. 4 RELATED ART
FIG. 4 is a waveform diagram showing a data and scanning pulses which are generated in the dot inversion method as shown in FIG. 3.
Figure 23:
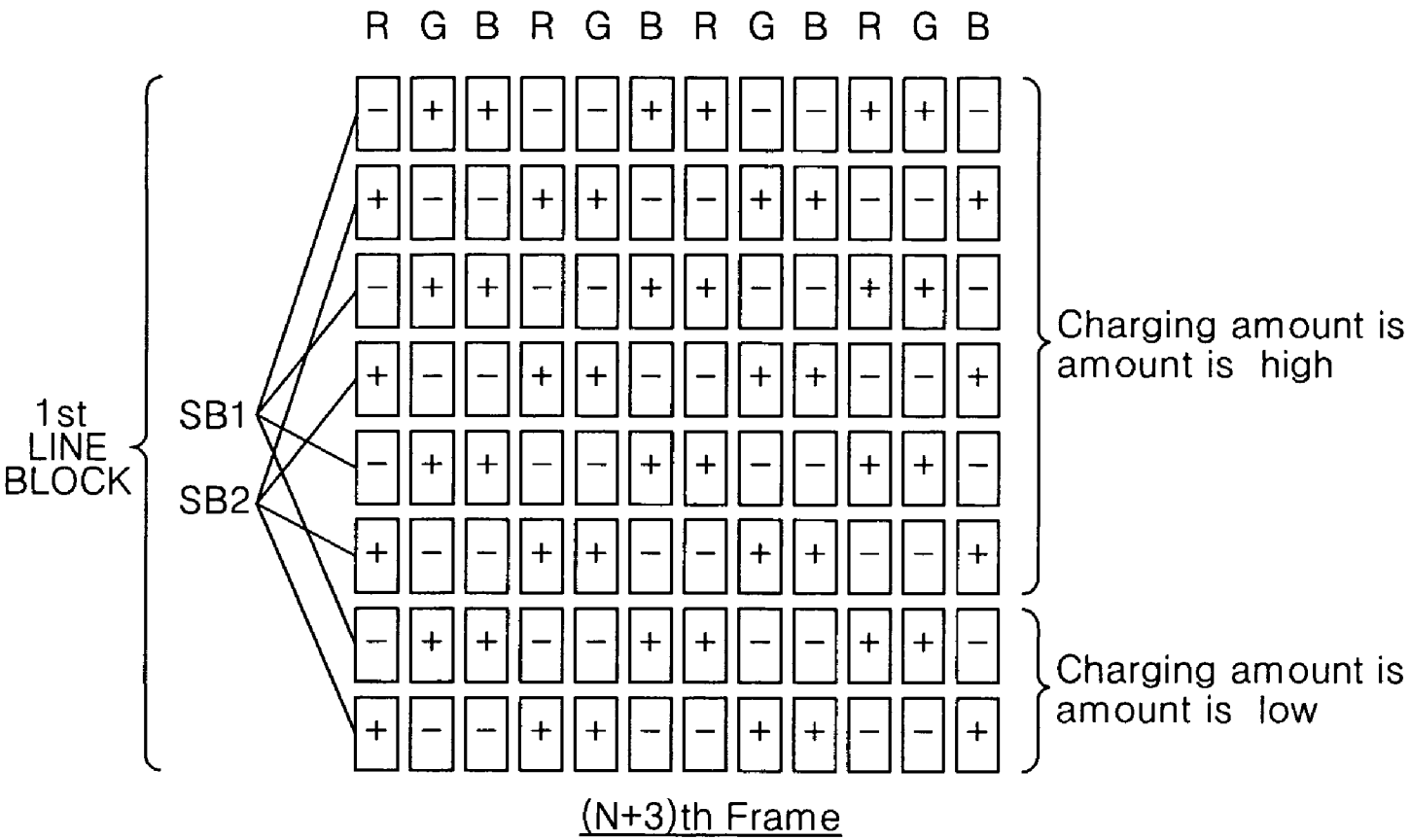
FIG. 23 is a diagram showing polarities and a charge amount of a data voltage which is charged in liquid crystal cells by the driving waveform of FIG. 22.
Figure 24:
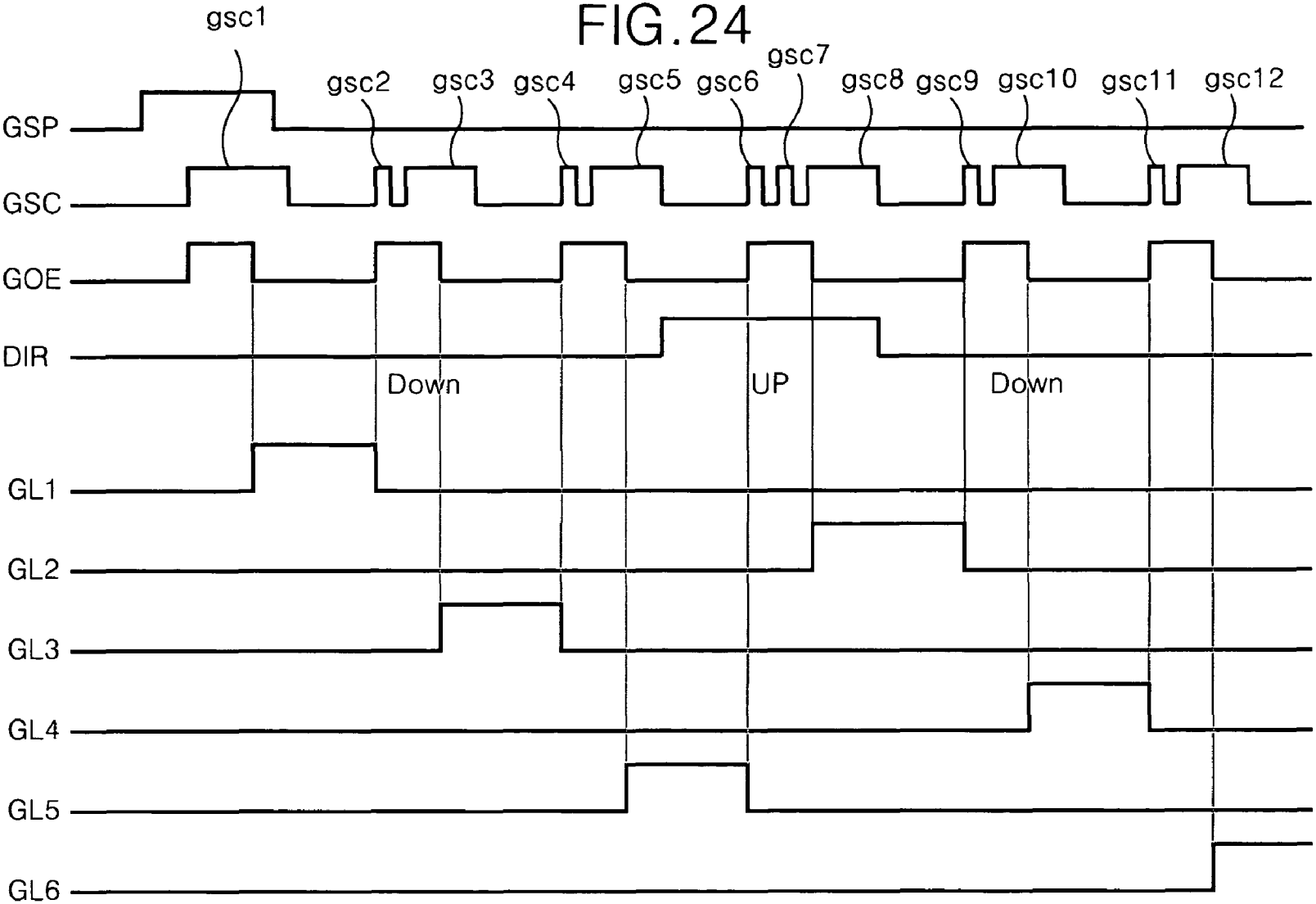
FIG. 24 shows control signals of the gate driver shown in FIG. 5, and is a waveform diagram showing gate control signals that generate scanning pulses of FIG. 10.

For the (N+3)th frame period, if the data voltages are charged in the liquid crystal cells of the first line block in the scanning sequence as shown in FIG. 2, the liquid crystal display panel is driven by the horizontal two dots inversion method and the vertical one dot inversion method as shown in FIG. 23. Also, the charge amounts of the seventh and eighth pixel rows become less than the charge amounts of the first to the sixth pixel rows as shown in FIG. 23.

Accordingly, as can be seen in FIG. 17, FIG. 19, FIG. 21, and FIG. 23, the charge amounts of all pixel rows become uniform for the four frame periods.

In the case where one line block includes the eight pixel rows, the scanning sequence that realizes the horizontal two dots inversion method and the vertical one dot inversion method and uniformly compensates the charge amount is not limited to the embodiments of FIG. 16 to FIG. 23. For example, applicable other embodiments of the present invention are as follows in the case where one line block includes the eight pixel rows. One of such examples, the first line block may be scanned in a sequence of the first gate line G1, the third gate line G3, the fifth gate line G5, the seventh gate line G7, the eighth gate line G8, the second gate line G2, the fourth gate line G4, and the sixth gate line G6 for the (N)th frame period. Also, the first line block may be scanned in a sequence of the third gate line G3, the fifth gate line G5, the seventh gate line G7, the first gate line G1, the second gate line G2, the fourth gate line G4, the sixth gate line G6, and the eighth gate line G8 for the (N+1)th frame period. Furthermore, the first line block may be scanned in a sequence of the fifth gate line G5, the seventh gate line G7, the first gate line G1, the third gate line G3, the fourth gate line G4, the sixth gate line G6, the eighth gate line G8, and the second gate line G2 for the (N+2)th frame period. Next, the first line block may be scanned in a sequence of the seventh gate line G7, the first gate line G1, the third gate line G3, the fifth gate line G5, the sixth gate line G6, the eighth gate line G8, the second gate line G2, and the fourth gate line G4 for the (N+3)th frame period.

The gate driver 240 must downwardly shift the scanning pulse and must upwardly shift the scanning pulse at each line block under the control of the timing controller 230 as shown in FIG. 14.

FIG. 14 shows control signals which control the gate driver 240 in order to generate the scanning pulses shown in FIG. 10.

Referring to FIG. 14, the gate driver 240 includes a shift register that has a plurality of stages connected in a cascading manner and sequentially shifts the gate start pulse GSP in accordance with the gate shift clock GSC. Also, the gate driver 240 shifts the scanning pulse toward the up-scanning direction and the down-scanning direction in response to the scanning direction signal DIR.

Whenever a pulse of a gate shift clock GSC is generated one by one, the shift register of the gate driver 240 shifts an output to the next stage, and outputs the scanning pulses between pulses of the gate output enable GOE. Accordingly, when a first gate shift clock pulse gsc1 is generated and the scanning direction signal DIR is generated as a low logic which indicates the down-scanning direction, the gate driver 240 supplies the scanning pulse to the first gate line GL1 for a period between pulses of the gate output enable GOE.

When a second gate shift clock pulse gsc2 having a narrow pulse width and a third gate shift clock pulse gsc3 having a wide pulse width are sequentially generated and the scanning direction signal DIR is generated as a low logic which indicates the down-scanning direction, the gate output enable pulse is overlapped with a portion of the second gate shift clock gsc2 and a portion of a third gate shift clock gsc3. The output is shifted to a second stage of the gate shift register by the second gate shift clock pulse gsc2. However, the output is cut-off by the gate output enable pulse, so that an output is substantially not generated from the second stage. When the third gate shift clock pulse gsc3 is generated, the scanning direction signal DIR is generated as a low logic which indicates the down-scanning direction. Thus, the output is downwardly shifted to a third stage of the shift register, and an output is generated from the third stage for the period between the pulses of the gate output enable, so that the scanning pulse is supplied to the third gate line GL3. Accordingly, the scanning pulse is supplied to the third gate line GL3 following the first gate line GL1.

When a fourth gate shift clock pulse gsc4 having a narrow pulse width and a fifth gate shift clock pulse gsc5 having a wide pulse width are sequentially generated and the scanning direction signal DIR is generated as a low logic which indicates the down-scanning direction, the gate output enable pulse is overlapped with a portion of the fourth gate shift clock gsc4 and a portion of a fifth gate shift clock gsc5. The output is shifted to a fourth stage of the gate shift register by the fourth gate shift clock pulse gsc4. However, the output is cut-off by the gate output enable pulse, so that an output is substantially not generated from the fourth stage. When the fifth gate shift clock pulse gsc5 is generated, the scanning direction signal DIR is generated as a low logic which indicates the down-scanning direction. Thus, the output is downwardly shifted to a fifth stage of the shift register, and an output is generated from the fifth stage, so that the scanning pulse is supplied to the fifth gate line GL5 for the period between the pulses of the gate output enable. Accordingly, the scanning pulse is supplied to the fifth gate line GL5 following the third gate line GL3.

The scanning direction signal DIR is inverted to a high logic which indicates the up-scanning direction. In this case, a sixth and seventh gate shift clock pulses gsc6 and gsc7 having a narrow pulse width and an eighth gate shift clock pulse gsc8 having a wide pulse width are sequentially generated. The gate output enable pulse is overlapped with the sixth and seventh gate shift clock pulses gsc6 and gsc7 and is overlapped with a portion of the eighth gate shift clock pulse gsc8. An output of the gate shift register is upwardly shifted as much as three stays by the sixth to eighth gate shift clock pulses gsc6, gsc7, and gsc8. However, the output is cut-off by the gate output enable pulse, so that an output is substantially not generated from the third and fourth stages. When the eighth gate shift clock pulse gsc8 is generated, the scanning direction signal DIR is generated as a high logic. Thus, the output is upwardly shifted to the second stage of the shift register, and an output is generated from the second stage, so that the scanning pulse is supplied to the second gate line GL2 for the period between the pulses of the gate output enable. Accordingly, the scanning pulse is supplied to the second gate line GL2 following the fifth gate line GL5.

The scanning direction signal DIR is inverted to a low logic which indicates the down-scanning direction. In this case, a ninth gate shift clock pulses gsc9 having a narrow pulse width and a tenth gate shift clock pulse gsc10 having a wide pulse width are sequentially generated. The gate output enable pulse is overlapped with the ninth gate shift clock pulse gsc9 and is overlapped with a portion of the tenth gate shift clock pulse gsc10. An output of the gate shift register is downwardly shifted as much as two stays by the ninth and tenth gate shift clock pulses gsc9 and gsc10. However, the output is cut-off by the gate output enable pulse, so that an output is substantially not generated from the third stage. When the tenth gate shift clock pulse gsc10 is generated, the scanning direction signal DIR is generated as a low logic. Thus, the output is downwardly shifted to the fourth stage of the shift register, and an output is generated from the fourth stage, so that the scanning pulse is supplied to the fourth gate line GL4 for the period between the pulses of the gate output enable. Accordingly, the scanning pulse is supplied to the fourth gate line GL4 following the second gate line GL2.

When a eleventh gate shift clock pulse gsc11 having a narrow pulse width and a twelfth gate shift clock pulse gsc12 having a wide pulse width are generated, the scanning direction signal DIR is maintained as a low logic. The gate output enable pulse is overlapped with the eleventh gate shift clock pulses gsc11 and is overlapped with a portion of the twelfth gate shift clock pulse gsc12. An output of the gate shift register is downwardly shifted as much as two stays by the eleventh and twelfth gate shift clock pulses gsc11 and gsc12. However, the output is cut-off by the gate output enable pulse, so that an output is substantially not generated from the fifth stage. When the twelfth gate shift clock pulse gsc12 is generated, the scanning direction signal DIR is generated as a low logic. Thus, the output is downwardly shifted to the sixth stage of the shift register, and an output is generated from the sixth stage, so that the scanning pulse is supplied to the sixth gate line GL6 for the period between the pulses of the gate output enable. Accordingly, the scanning pulse is supplied to the sixth gate line GL6 following the fourth gate line GL4.

Figure 25:
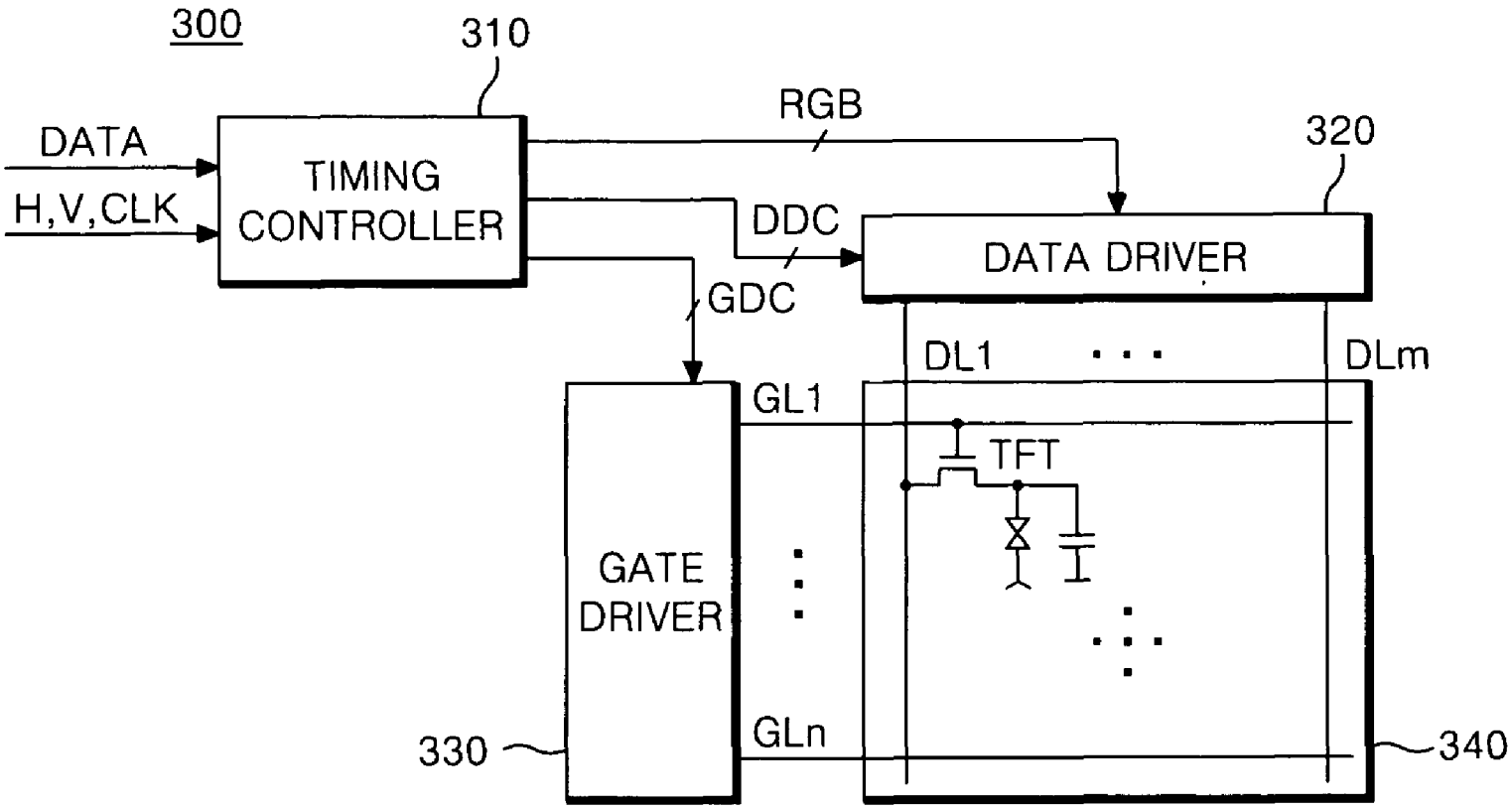
FIG. 25 is a block diagram showing a liquid crystal display according to another embodiment of the present invention.

FIG. 25 is a diagram showing a configuration of a liquid crystal display according to another embodiment of the present invention. Herein, a liquid crystal display 300 according to another embodiment of the present invention includes the gamma reference voltage generator 130, the backlight assembly 140, the inverter 150, the common voltage generator 160, and the gate driving voltage generator 170 similar to the liquid crystal display 100 shown in FIG. 2. However, for the sake of convenience, these configurations are not shown in FIG. 25.

Referring to FIG. 11, the liquid crystal display 300 according to another embodiment of the present invention includes a liquid crystal display panel 340, a data driver 320, a gate driver 330, and a timing controller 310.

The timing controller 310 supplies the digital video data RGB, which are supplied from a system, to the data driver 320 in a sequence of digital video data of the first pixel row, digital video data of the second pixel row, digital video data of the third pixel row, and . . . digital video data of the (m)th pixel row. Furthermore, the timing controller 310 generates the data driving control signal DCC and the gate driving control signal GDC using the clock signal CLK and the horizontal/vertical synchronizing signals H and V to supply them to the data driver 320 and the gate driver 330, respectively. Herein, the data driving control signal DDC includes the source shift clock SSC, the source start pulse SSP, the polarity control signal POL, and the source output enable signal SOE, etc. The gate driving control signal GDC includes the gate shift clock GSC, the gate start pulse GSP, and a gate output enable signal GOE, etc.

Specifically, the timing controller 310 supplies a selection signal SEL, a source output enable signal SOE, and a signal for controlling a data supplying sequence DPS. Herein, the selection signal SEL controls a demultiplexing of the data driver 320. The source output enable signal SOE controls an output of m digital video data which are latched for each data block within the data driver 320. The signal for controlling the data supplying sequence DPS controls a multiplexing of the data driver 320. Also, the timing controller 310 supplies a gate driving control signal GDC, which indicates a sequence of a scanning pulse supplied to the gate line of n pixel rows, to the gate driver 330. Furthermore, the timing controller 310 supplies the scanning direction signal DIR, which controls the up-scanning direction and the down-scanning direction of scanning pulses at each lien block, to the gate driver 320.

As the above-mentioned embodiment, the liquid crystal display panel is driven by the horizontal two dots inversion method and the vertical one dot inversion method. However, the timing controller 310 supplies data to the data driver 320 using the same method as the related art, and the data driver 320 re-aligns data using a demultiplexer and a multiplexer in accordance with a change of the scanning sequence.

If m digital video data, which are supplied from the timing controller 310, are supplied, the data driver 320 primarily latches the digital video data, and then demultiplexes the latched m digital video data to divide them into each data block. In this case, the data driver 320 generates i data blocks, which include m digital video data, through a demultiplexing process. Herein, one data block includes m digital video data of the first pixel row which is selected by the scanning pulse of the gate line.

The data driver 320 sequentially latches the m digital video data, which are demultiplexed to the i data blocks, for each data block, and then multiplexes the latched i data blocks in accordance with the scanning sequence.

The data driver 320 converts the m digital video data of the data block, which is selected through a multiplexing process, among the i data blocks into an analog data voltage to supply it to the data lines DL1 to DLm.

If the scanning sequence of the gate lines is the first gate line GL1, the third gate line GL3, the second gate line GL2, and the fourth gate line GL4 as shown in the following example, the data driver 320 secondarily latches the digital video data in a sequence of the digital video data of the first pixel row, the digital video data of the second pixel row, the digital video data of the third pixel row, and the digital video data of the fourth pixel row, and then multiplexes them to synchronize the data voltages, which are supplied to the data lines DL1 to DLm, with scanning pulses of the changed scanning sequence.

The gate driver 330 changes each scanning sequence of the sub-blocks for each frame period under the control of the timing controller 310 as shown in the embodiments of FIG. 6 to FIG. 24.

Figure 26:
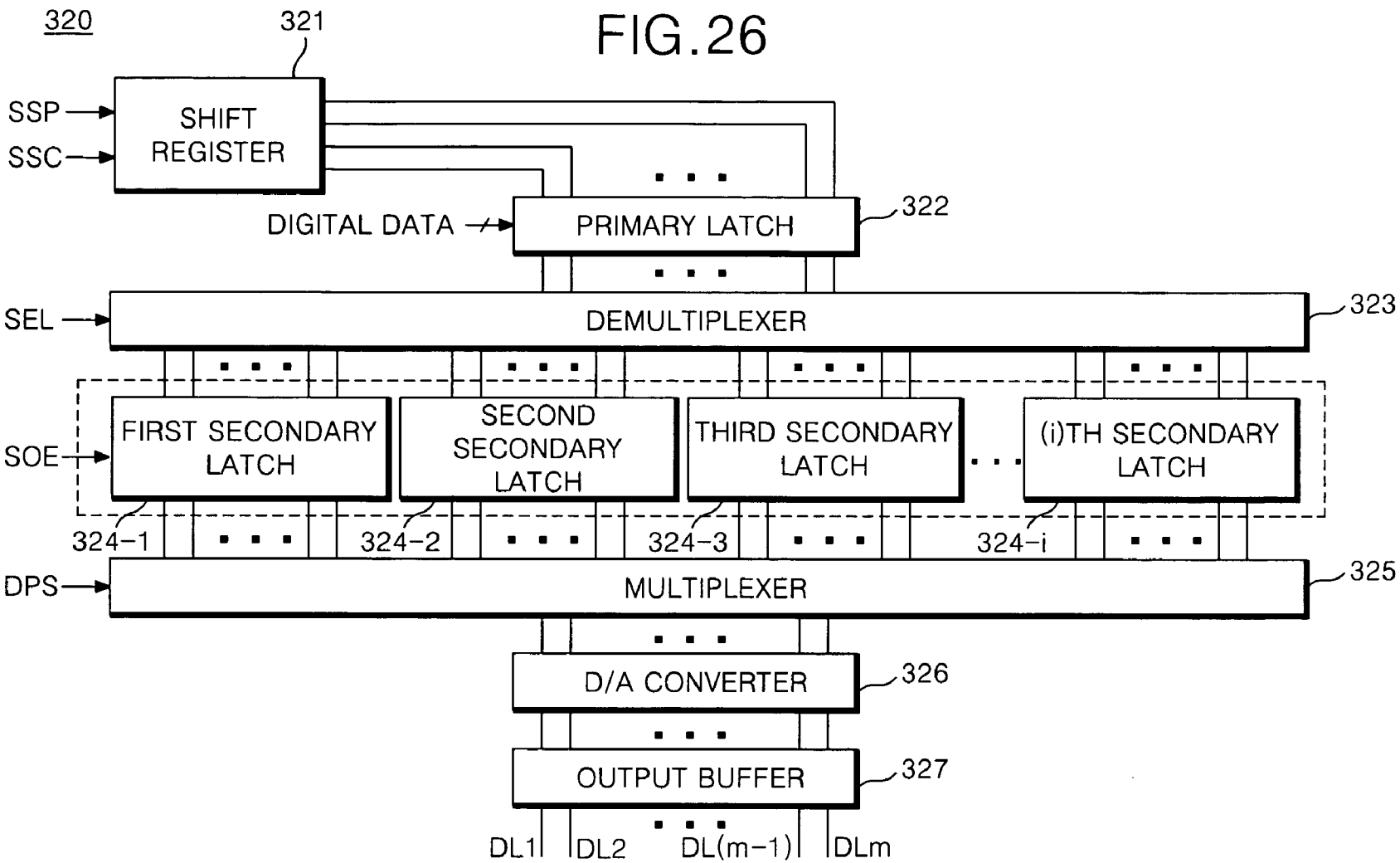
FIG. 26 is a circuit diagram showing the data driver shown in FIG. 25, in detail.

FIG. 26 is a diagram showing an internal configuration of the data driver 320 shown in FIG. 25.

Referring to FIG. 26, the data driver 320 includes a shift register 321, a primary latch part 322, a demultiplexer 323, a first to (i)th secondary latch parts 324-1 to **324-*i*, a multiplexer 325, a D/A converter 326, and an output buffer 327. Herein, the shift register generates sampling signals which are used for a primary latch of the digital video data. The primary latch part 322 primarily latches the m inputted digital video data in accordance with the sampling signals. The demultiplexer 323** demultiplexes the m primarily latched digital video data. The first to (i)th secondary latch part 324-1 to **324-*i* secondarily latches the first to (i)th data blocks having the m demultiplexed digital video data. The multiplexer 325 continuously outputs the first to (i)th data blocks having the m secondarily latched digital video data in accordance with a supply sequence which is indicated by the timing controller 310. The D/A converter 326 converts m digital video data of a data block, which are continuously outputted through the multiplexer 325 among the first to (i)th data blocks, into m analog data voltages. The output buffer 327 buffers the m converted analog data voltages to supply them to the data lines DL1** to DLm.

The shift register 321 shifts the source start pulse SSP from the timing controller 310 to generate sampling signals, which are used for a primary latch of the digital, video data, thereby supplying them to the primary latch part 322 in accordance with the source shift clock signal SSC which is inputted from the timing controller 310.

The primary latch part 322 primarily latches the m digital video data, which are inputted from the timing controller 310, and then outputs them to the demultiplexer 323 in accordance with sampling signals from the shift register 321.

The demultiplexer 323 demultiplexes m digital video data, which are primarily latched by the primary latch part 322, to output the first to (i)th data blocks having the m digital video data in accordance with the selection signal SEL from the timing controller 310. The number of bits of the selection signal SEL is determined depending upon the number of data blocks, that is, the number of secondary latch parts. Herein, the m digital video data of the first data block, the m digital video data of the second data block, the m digital video data of the third data block, the m digital video data of the (i)th data block are outputted to the first to (i)th secondary latch parts 324-1 to **324-*i***, one to one relationship.

The first secondary latch part 324-1 secondarily latches m digital video data of the first data block, which are inputted from the demultiplexer 323, and then outputs the m latched digital video data of the first data block to the multiplexer 325 in synchronizing with a falling edge of the source output enable signal SOE from the timing controller 310.

The second secondary latch part 324-2 secondarily latches m digital video data of the second data block, which are inputted from the demultiplexer 323, and then outputs the m latched digital video data of the second data block to the multiplexer 325 in synchronizing with the falling edge of the source output enable signal SOE from the timing controller 310.

The third secondary latch part 324-3 secondarily latches m digital video data of the third data block, which are inputted from the demultiplexer 323, and then outputs the m latched digital video data of the third data block to the multiplexer 325 in synchronizing with the falling edge of the source output enable signal SOE from the timing controller 310.

The (i)th secondary latch part **324-*i* secondarily latches m digital video data of the (i)th data block, which are inputted from the demultiplexer 323, and then outputs the m latched digital video data of the (i)th data block to the multiplexer 325 in synchronizing with the falling edge of the source output enable signal SOE from the timing controller 310**.

The multiplexer 325 continuously outputs the first to (i)th data blocks having the m digital video data, which are secondarily latched by the first to (i)th secondary latch parts 324-1 to **324-*i*, to the D/A converter 326** in accordance with a supply sequence which is indicated by the signal for controlling the data supplying sequence DPS. Herein, the number of bits of the signal for controlling the data supplying sequence DPS is determined depending upon the number of the data blocks, that is, the number of the secondary latch parts.

As described above, the present invention changes a sequence of a scanning pulse with which the pixel rows having the gate lines, which are arranged at each line block, are supplied, and supplies data of the data blocks which are secondarily latched by the first to (i)th secondary latch parts 324-1 to **324-*i*. Thus, the present invention supplies at least 2 times an analog data voltage, which has the same polarity on the basis of the common voltage Vcom to reduce a polarity inversion period of a data voltage by half, thereby sharply decreasing a temperature within the data driver 320 in comparison with the liquid crystal display of the related art which alternatively converts the positive data voltage and the negative data voltage. As a result, the present invention prevents a degradation of an internal circuit of the data driver 320**.

The D/A converter 326 converts the m digital video data of the data block, which are selected and inputted by the multiplexer 325, into m analog data voltages to output them to the output buffer 327. Herein, the D/A converter 326 converts the inputted digital video data into a positive analog data voltage or a negative analog data voltage in accordance with the polarity control signal POL from the timing controller 310. The D/A converter 326 converts a polarity of the data voltage using any one of a dot inversion method, a N dot inversion method, a line inversion method, and a column inversion method in response to the polarity control signal POL from the timing controller 310.

The output buffer 327 buffers m data voltages, which are converted by the D/A converter 326, to supply them to a plurality of data lines DL1 to DLm which are formed at the liquid crystal display panel 340.

Figure 27:
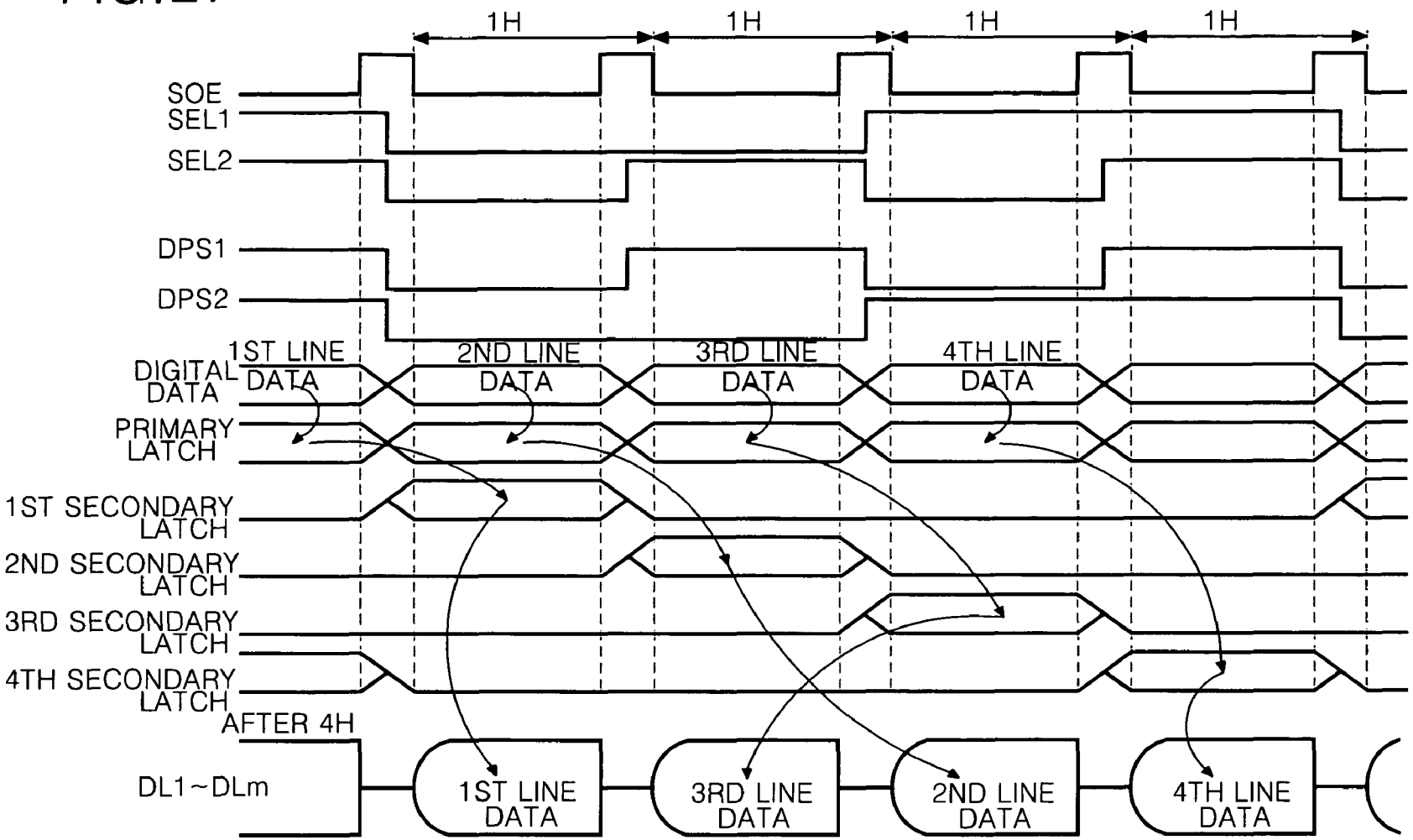
FIG. 27 is a waveform diagram showing timing control signals and data which control the circuit shown in FIG. 26.

FIG. 27 shows a driving waveform of the data driver 320 which operates in accordance with the scanning sequence shown in FIG. 6. Herein, the secondary latch part includes four latch parts that latches four data blocks (or four pixel row data) with time-divide method. The selection signal SEL, which controls the demultiplexer 323, and the signal for controlling the data supplying sequence DPS are comprised of two bits in order to select each of the four latch parts, respectively.

The data driver 320 receives the digital video data in a sequence of the digital video data of the first pixel row, the digital video data of the second pixel row, the digital video data of the third pixel row, and the digital video data of the fourth pixel row.

Referring to FIG. 26 and FIG. 27, the first selection signal SEL1 is generated as a low logic L(0) for a first and second horizontal periods, and then is generated as a high logic H(1) for a third and fourth horizontal periods. A logic of the second selection signal SEL2 is inverted for each horizontal period to be generated as the low logic L(0) for the first horizontal period, as the high logic H(1) for the second horizontal period, as the low logic L(0) for the third horizontal period, and as the high logic H(1) for the fourth horizontal period.

If the first and second selection signals SEL1 and SEL2 are 'LL(00)', the demultiplexer 323 supplies the digital video data from the primary latch 322 to the first secondary latch part 324-1. If the first and second selection signals SEL1 and SEL2 are 'LH(01)', the demultiplexer 323 supplies the digital video data from the primary latch 322 to the second secondary latch part 324-2. If the first and second selection signals SEL1 and SEL2 are 'HL(10)', the demultiplexer 323 supplies the digital video data from the primary latch 322 to the third secondary latch part 324-3. If the first and second selection signals SEL1 and SEL2 are 'HH(11)', the demultiplexer 323 supplies the digital video data from the primary latch 322 to the fourth secondary latch part 324-4.

A logic of a first signal for controlling a data supplying sequence DPS1 is inverted for each horizontal period to be generated as the low logic L(0) for the first horizontal period, as the high logic H(1) for the second horizontal period, as the low logic L(0) for the third horizontal period, and as the high logic H(1) for the fourth horizontal period. A second signal for controlling a data supplying sequence DPS2 is generated as the low logic L(0) for the first and second horizontal periods, and then is generated as the high logic H(1) for the third and fourth horizontal periods.

If the first and second signals for controlling the data supplying sequence DPS1 and DPS2 are 'LL(00)', the multiplexer 325 supplies the digital video data from the first secondary latch part 324-1 to the D/A converter 326. If the first and second signals for controlling the data supplying sequence DPS1 and DPS2 are 'HL(10)', the multiplexer 325 supplies the digital video data from the third secondary latch part 324-3 to the D/A converter 326. If the first and second signals for controlling the data supplying sequence DPS1 and DPS2 are 'LH(01)', the multiplexer 325 supplies the digital video data from the second secondary latch part 324-2 to the D/A converter 326. If the first and second signals for controlling the data supplying sequence DPS1 and DPS2 are 'HH (11)', the multiplexer 325 supplies the digital video data from the fourth secondary latch part 324-4 to the D/A converter 326.

Accordingly, for the first horizontal period when the selection signals SEL1 and SEL2 are 'LL(00)' and the signals for controlling the data supplying sequence DPS1 and DPS2 are 'LL(00), the digital video data of the first pixel row, which are latched at the primary latch part 322, are passed through the first secondary latch part 324-1 to be converted into an analog data voltage after four horizontal periods 4H. Further, the data voltages of the first pixel row are synchronized with a falling edge of the source output enable signal SOE to be supplied to the data lines DL1 to DLm.

For the second horizontal period when the selection signals SEL1 and SEL2 are 'LH(01)' and the signals for controlling the data supplying sequence DPS1 and DPS2 are 'HL(10), the digital video data of the third pixel row, which are latched at the primary latch part 322, are passed through the third secondary latch part 324-3 to be converted into an analog data voltage after four horizontal periods 4H. Further, the data voltages of the third pixel row are synchronized with the falling edge of the source output enable signal SOE to be supplied to the data lines DL1 to DLm.

For the third horizontal period when the selection signals SEL1 and SEL2 are 'HL(10)' and the signals for controlling the data supplying sequence DPS1 and DPS2 are 'LH(01), the digital video data of the second pixel row, which are latched at the primary latch part 322, are passed through the second secondary latch part 324-2 to be converted into an analog data voltage after four horizontal periods 4H. Further, the data voltages of the second pixel row are synchronized with the falling edge of the source output enable signal SOE to be supplied to the data lines DL1 to DLm.

For the fourth horizontal period when the selection signals SEL1 and SEL2 are 'HH(11)' and the signals for controlling the data supplying sequence DPS1 and DPS2 are 'HH(11), the digital video data of the fourth pixel row, which are latched at the primary latch part 322, are passed through the fourth secondary latch part 324-4 to be converted into an analog data voltage after four horizontal periods 4H. Further, the data voltages of the fourth pixel row are synchronized with the falling edge of the source output enable signal SOE to be supplied to the data lines DL1 to DLm.

The present invention, which has the above-mentioned characteristics, has the following effect.

First, the present invention changes the supply sequence of the scanning pulse, which is supplied to the plurality of gate lines, to realize the one dot inversion, thereby preventing a temperature rise within the data driver that supplies an analog data voltage. As a result, the present invention can prevent a degradation of the data driver.

Second, the present invention changes the supply sequence of the scanning pulse at odd-numbered frames and the supply sequence of the scanning pulse at even-numbered frames to be symmetrical with each other to offset a picture quality deterioration, which is caused by a non-uniform of the charge amount, in the case where the supply sequence of the scanning pulse, which is supplied to the plurality of gate lines, is changed to realize the one dot inversion. As a result, the present invention can maintain a picture quality although the supply sequence of the scanning pulse is changed to realize the one dot inversion.

Third, the present invention changes the supply sequence of the analog data voltage, which is supplied to the plurality of pixel rows, and the supply sequence of the scanning pulse, which is supplied to the plurality of pixel rows, to be corresponded to each other to reduce the polarity inversion period of the data voltage by half, thereby reducing a temperature of the internal circuit of the data driver. As a result, the present invention can prevent a degradation of the internal circuit of the data driver.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a liquid crystal display panel that has a plurality of data lines and a plurality of gate lines, which are crossed each other, and pixels, which are defined by the lines;

a gate driver that supplies scanning pulses to the gate lines, and changes a supply sequence of the scanning pulses for each frame;

a data driver that converts digital video data into data voltages and periodically inverts a polarity of the data voltages to supply the data voltages in accordance with a supply sequence of the scanning pulses; and a timing controller that supplies the digital video data to the data driver, and controls the data driver and the gate driver, and wherein a polarity of data voltages, which are supplied to the liquid crystal display panel, is inverted for each liquid crystal cell and a polarity of a data voltage which is outputted from the data driver, is inverted for every two to four horizontal periods, wherein the liquid crystal display panel is divided into k line blocks (k is a positive integer less than n/2) having n gate lines (n is an even number), and each of the line block is divided into a first and second sub-blocks having i gate lines (i is an even number less than n), wherein the gate driver shifts the scanning pulse toward an up-scanning direction and a down-scanning direction in accordance with a scanning direction signal from the timing controller.

2. The liquid crystal display according to claim 1, wherein the gate driver shifts the scanning pulse toward an up-scanning direction and a down-scanning direction within the line block, and supplies the scanning pulse to the gate lines.

3. The liquid crystal display according to claim 1, wherein a polarity pattern of the data voltage, which is supplied to pixel rows of the first sub-block, is different from a polarity pattern of the data voltage which is supplied to pixel rows of the second sub-block.

4. The liquid crystal display according to claim 1, wherein the gate driver sequentially supplies the scanning pulse to gate lines, which are included in the first sub-block, and then sequentially supplies the scanning pulse to gate lines which are included in the second sub-block.

5. The liquid crystal display according to claim 4, wherein the gate driver changes a supply sequence of the scanning pulse within the sub-block for the each frame.

6. The liquid crystal display according to claim 4, wherein the first sub-block includes odd-numbered gate lines, and the second sub-block includes even-numbered gate lines.

7. The liquid crystal display according to claim 1, further includes:

a data re-aligner that re-aligns the digital video data in accordance with a supply sequence of the scanning pulses, and wherein the timing controller supplies the digital video data from the data re-aligner to the data driver.

8. The liquid crystal display according to claim 1, wherein the data driver includes:

a primary latch that samples and latches digital video data from the timing controller;

a plurality of secondary latches that latch the digital video data in accordance with a supply sequence of the scanning pulses; and a demultiplexer that distributes the digital video data to secondary latches in accordance with a supply sequence of the scanning pulses.

9. A method of driving a liquid crystal display, including a liquid crystal display panel that has a plurality of data lines and a plurality of gate lines which are crossed each other and pixels which are defined by the lines, a gate driver that supplies scanning pulses to the gate lines and changes a supply sequence of the scanning pulses for each frame, and a data driver that converts digital video data into data voltages and periodically inverts a polarity of the data voltages to supply the data voltages in accordance with a supply sequence of the scanning pulses, comprising:

generating a plurality of control signals to control the gate driver and the data driver;

diversely controlling a supply sequence of the scanning pulses for each frame; and supplying the data voltages to the data lines in accordance with a supply sequence of the scanning pulses, and wherein a polarity of data voltages, which are supplied to the liquid crystal display panel, is inverted for each liquid crystal cell and a polarity of a data voltage which is outputted from the data driver, is inverted for every two to four horizontal periods, wherein the liquid crystal display panel is divided into k line blocks (k is a positive integer less than n/2) having n gate lines (n is an even number), and each of the line block is divided into a first and second sub-blocks having i gate lines (i is an even number less than n), wherein the plurality of control signals includes a scanning direction signal to shift the scanning pulse toward an up-scanning direction and a down-scanning direction.

10. The method of driving the liquid crystal display according to claim 9, wherein the step of diversely controlling the supply sequence of the scanning pulses includes:

shifting the scanning pulse toward an up-scanning direction and a down-scanning direction within the line block, and supplying the scanning pulse to the gate lines.

11. The method of driving the liquid crystal display according to claim 10, wherein a polarity pattern of the data voltage, which is supplied to pixel rows of the first sub-block, is different from a polarity pattern of the data voltage which is supplied to pixel rows of the second sub-block.

12. The method of driving the liquid crystal display according to claim 9, wherein the step of diversely controlling the supply sequence of the scanning pulses includes:

sequentially supplies the scanning pulse to gate lines, which are included in the first sub-block, and then sequentially supplying the scanning pulse to gate lines which are included in the second sub-block.

13. The method of driving the liquid crystal display according to claim 12, wherein the step of diversely controlling the supply sequence of the scanning pulses includes:

changing a supply sequence of the scanning pulse within the sub-block for the each frame.

14. The method of driving the liquid crystal display according to claim 12, wherein the first sub-block includes odd-numbered gate lines, and the second sub-block includes even-numbered gate lines.

15. The method of driving the liquid crystal display according to claim 9, further includes:

re-aligning digital video data to be inputted to the data driver in accordance with the supply sequence of the scanning pulse.

16. The method of driving the liquid crystal display according to claim 9, further includes:

sampling and latching the digital video data using a first latch part; and distributing the digital video data to a plurality of secondary latch part in accordance with the supply sequence of the scanning pulses within the data driver.

* * * * *